US007562960B2

(12) United States Patent
Berry et al.

(10) Patent No.: US 7,562,960 B2
(45) Date of Patent: Jul. 21, 2009

(54) INKJET PRINTER HAVING ARCUATELY MOVEABLE PRINTHEAD AND CAPPING/PURGING MEMBER

(75) Inventors: Norman Micheal Berry, Balmain (AU); Akira Nakazawa, Balmain (AU); Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 127 days.

(21) Appl. No.: 11/778,563

(22) Filed: Jul. 16, 2007

(65) Prior Publication Data

US 2007/0257958 A1 Nov. 8, 2007

Related U.S. Application Data

(63) Continuation of application No. 11/003,601, filed on Dec. 6, 2004, now Pat. No. 7,255,419.

(51) Int. Cl.
*B41J 2/165* (2006.01)

(52) U.S. Cl. ..... 347/29; 347/30; 347/32

(58) Field of Classification Search ..... 347/32, 347/31, 29, 30

See application file for complete search history.

(56) References Cited

U.S. PATENT DOCUMENTS

| | | | | |
|---|---|---|---|---|
| 4,369,456 | A | 1/1983 | Cruz-Uribe et al. | |
| 5,481,290 | A | 1/1996 | Watanabe | |
| 6,183,059 | B1 | 2/2001 | Muhl et al. | |
| 6,536,874 | B1 | 3/2003 | Silverbrook | |
| 6,984,017 | B1 * | 1/2006 | Berry et al. | 347/32 |
| 7,255,419 | B2 * | 8/2007 | Berry et al. | 347/30 |
| 7,328,968 | B2 * | 2/2008 | Berry et al. | 347/32 |
| 2003/0081055 | A1 | 5/2003 | Wotton et al. | |
| 2003/0231222 | A1 | 12/2003 | Jefferson et al. | |

FOREIGN PATENT DOCUMENTS

| | | | |
|---|---|---|---|
| DE | 19726643 | C1 | 7/1998 |
| EP | 0430077 | B1 | 3/1996 |
| EP | 0744294 | B1 | 10/1999 |
| EP | 1462264 | A1 | 9/2004 |
| JP | 05-330037 | A | 12/1993 |
| JP | 2002-059559 | A | 2/2002 |
| WO | WO 01/87623 | A | 11/2001 |

* cited by examiner

*Primary Examiner*—Manish S Shah

(57) ABSTRACT

An inkjet printer is provided which has at least one pagewidth printhead having a plurality of ink ejection nozzles, a capping/purging member having a length corresponding substantially to that of the printhead, a first actuating mechanism arranged to move the printhead in an arcuate first direction between first, second and third positions, and a second actuating mechanism arranged to move the capping/purging member in an arcuate second direction opposite to the first direction to cap the nozzles of the printhead when the printhead is in the second position and to permit purging of ink from the nozzles when the printhead is in the third position.

9 Claims, 39 Drawing Sheets

INKJET PRINTER HAVING ARCUATELY MOVEABLE PRINTHEAD AND CAPPING/PURGING MEMBER

CROSS REFERENCE TO RELATED APPLICATION

This application is a continuation of U.S. application Ser. No. 11/003,601 filed on Dec. 6, 2004 all of which are herein incorporated by reference.

CO-PENDING APPLICATIONS

The following applications have been filed by the Applicant simultaneously with the present application:

| | | | | | |
|---|---|---|---|---|---|
| 11/003,786 | 11/003,616 | 11/003,418 | 11/003,334 | 11/003,600 | 11/003,404 |
| 11/003,419 | 11/003,700 | 11/003,618 | 11/003,615 | 11/003,337 | 11/003,698 |
| 11/003,420 | 6,984,017 | 11/003,699 | 11/003,463 | 11/003,701 | 11/003,683 |
| 11/003,614 | 11/003,702 | 11/003,684 | 11/003,619 | 11/003,617 | |

The disclosures of these co-pending applications are incorporated herein by reference.

CROSS REFERENCES TO RELATED APPLICATIONS

The following patents or patent applications filed by the applicant or assignee of the present invention are hereby incorporated by cross-reference.

| | | | | | |
|---|---|---|---|---|---|
| 6,623,101 | 6,406,129 | 6,505,916 | 6,457,809 | 6,550,895 | 6,457,812 |
| 7,152,962 | 6,428,133 | 7,204,941 | 10/815,624 | 10/815,628 | 10/913,375 |
| 10/913,373 | 10/913,374 | 10/913,372 | 7,138,391 | 7,153,956 | 10/913,380 |
| 10/913,379 | 10/913,376 | 7,122,076 | 7,148,345 | 10/407,212 | 10/407,207 |
| 10/683,064 | 10/683,041 | 6,746,105 | 7,156,508 | 7,159,972 | 7,083,271 |
| 7,165,834 | 7,080,894 | 7,201,469 | 7,090,336 | 7,156,489 | 10/760,233 |
| 10/760,246 | 7,083,257 | 10/760,243 | 10/760,201 | 7,219,980 | 10/760,253 |
| 10/760,255 | 10/760,209 | 7,118,192 | 10/760,194 | 10/760,238 | 7,077,505 |
| 7,198,354 | 7,077,504 | 10/760,189 | 7,198,355 | 10/760,232 | 10/760,231 |
| 7,152,959 | 7,213,906 | 7,178,901 | 7,222,938 | 7,108,353 | 7,104,629 |
| 10/728,804 | 7,128,400 | 7,108,355 | 6,991,322 | 10/728,790 | 7,118,197 |
| 10/728,970 | 10/728,784 | 10/728,783 | 7,077,493 | 6,962,402 | 10/728,803 |
| 7,147,308 | 10/728,779 | 7,118,198 | 7,168,790 | 7,172,270 | 10/773,199 |
| 6,830,318 | 7,195,342 | 7,175,261 | 10/773,183 | 7,108,356 | 7,118,202 |
| 10/773,186 | 7,134,744 | 10/773,185 | 7,134,743 | 7,182,439 | 7,210,768 |
| 10/773,187 | 7,134,745 | 7,156,484 | 7,118,201 | 7,111,926 | 10/773,184 |
| 09/575,197 | 7,079,712 | 09/575,123 | 6,825,945 | 09/575,165 | 6,813,039 |
| 6,987,506 | 7,038,797 | 6,980,318 | 6,816,274 | 7,102,772 | 09/575,186 |
| 6,681,045 | 6,728,000 | 7,173,722 | 7,088,459 | 09/575,181 | 7,068,382 |
| 7,062,651 | 6,789,194 | 6,789,191 | 6,644,642 | 6,502,614 | 6,622,999 |
| 6,669,385 | 6,549,935 | 6,987,573 | 6,727,996 | 6,591,884 | 6,439,706 |
| 6,760,119 | 09/575,198 | 6,290,349 | 6,428,155 | 6,785,016 | 6,870,966 |
| 6,822,639 | 6,737,591 | 7,055,739 | 09/575,129 | 6,830,196 | 6,832,717 |
| 6,957,768 | 7,170,499 | 7,106,888 | 7,123,239 | 10/727,181 | 10/727,162 |
| 10/727,163 | 10/727,245 | 7,121,639 | 7,165,824 | 7,152,942 | 10/727,157 |
| 7,181,572 | 7,096,137 | 10/727,257 | 10/727,238 | 7,188,282 | 10/727,159 |
| 10/727,180 | 10/727,179 | 10/727,192 | 10/727,274 | 10/727,164 | 10/727,161 |
| 10/727,198 | 10/727,158 | 10/754,536 | 10/754,938 | 10/727,227 | 10/727,160 |
| 10/934,720 | 10/296,522 | 6,795,215 | 7,0700,98 | 7,154,638 | 6,805,419 |
| 6,859,289 | 6,977,751 | 6,398,332 | 6,394,573 | 6,622,923 | 6,747,760 |
| 6,921,144 | 10/884,881 | 7,092,112 | 7,192,106 | 10/854,521 | 10/854,522 |
| 10/854,488 | 10/854,487 | 10/854,503 | 10/854,504 | 10/854,509 | 7,188,928 |
| 7,093,989 | 10/854,497 | 10/854,495 | 10/854,498 | 10/854,511 | 10/854,512 |
| 10/854,525 | 10/854,526 | 10/854,516 | 10/854,508 | 10/854,507 | 10/854,515 |
| 10/854,506 | 10/854,505 | 10/854,493 | 10/854,494 | 10/854,489 | 10/854,490 |

-continued

| | | | | | |
|---|---|---|---|---|---|
| 10/854,492 | 10/854,491 | 10/854,528 | 10/854,523 | 10/854,527 | 10/854,524 |
| 10/854,520 | 10/854,514 | 10/854,519 | 10/854,513 | 10/854,499 | 10/854,501 |
| 10/854,500 | 10/854,502 | 10/854,518 | 10/854,517 | 10/934,628 | |

FIELD OF THE INVENTION

This invention relates in general terms to an inkjet printer and, in particular to pagewidth printhead assemblies with associated capping mechanisms and or nozzle purging systems. By "pagewidth" printhead assembly it is meant an assembly having a printhead with a length which extends across substantially the full width of the media (paper, card, textile or other) to be printed and which, whilst remaining in a stationary position, is controlled to deposit printing ink across the full print width of advancing print media.

BACKGROUND OF THE INVENTION

Inkjet printers have a series of nozzles from which individual ink droplets are ejected to deposit on print media to form desired printed images. The nozzles are incorporated in various types of printheads and their proper functioning is critical to the creation of quality images. Thus, any partial or total blockage of even a single nozzle may have a significant impact on a printed image, particularly in the case of a pagewidth printer.

The nozzles are prone to blockage due to their exposure to ever-present paper dust and other particulate matter and due to the tendency of ink to dry in the nozzles during, often very short, idle periods. Prior to ejection, the ink forms a meniscus at the nozzle opening. Exposure to air (frequently warm) evaporates the ink solvent to leave a solid deposit that can block the nozzle.

Servicing systems are conventionally employed for maintaining the functionality of printheads. Such systems provide capping, purging and or wiping. Capping involves the covering of idle nozzles to preclude exposure of ink to drying air. Purging is normally effected by evacuating a capping chamber, thereby sucking deposits from the printhead that block or have the potential to block the nozzles. Wiping is performed in conjunction with the capping and/or purging functions and involves gently sweeping a membrane across the face of the printhead.

Most conventional inkjet printers use a reciprocating printhead which is traverses across the width of a momentarily stationary page or portion of print media. In these printers, service stations are provided at one side of the printing zone and, on command, the printhead is traversed to the service station where it is docked while servicing is performed and or the printer is idle.

The above described servicing system is not feasible for pagewidth printers because of the stationary printhead assembly that extends across the full width of the printing zone. The printhead assembly effectively defines the print zone and it cannot be moved outside of that zone for servicing. Furthermore, a pagewidth printhead has a significantly larger surface area and contains a vastly greater number of nozzles than a conventional inkjet printhead, especially in the case of a large format printer. These factors dictate that the servicing of printheads requires an entirely different approach to that of conventional scanning type printheads.

SUMMARY OF THE INVENTION

In a first aspect the present invention provides an inkjet printer comprising:

- at least one pagewidth printhead having a plurality of ink ejection nozzles;
- a capping/purging member having a length corresponding substantially to that of the printhead;
- a first actuating mechanism arranged to move the printhead in an arcuate first direction between first, second and third positions; and
- a second actuating mechanism arranged to move the capping/purging member in an arcuate second direction opposite to the first direction to cap the nozzles of the printhead when the printhead is in the second position and to permit purging of ink from the nozzles when the printhead is in the third position.

Optionally, the capping/purging member is formed effectively as a one-piece member.

Optionally, the capping/purging member comprises conjoined member portions having an aggregate length corresponding substantially to that of the printhead.

Optionally, the capping/purging member comprises a body portion, a lip portion formed from an elastomeric material, a capping cavity surrounded by the lip portion, and a purging chamber surrounded by the lip portion.

Optionally, the purging chamber is connected to a suction device.

Optionally, the printer comprises two opposed pagewidth printheads, wherein the first actuating mechanism is arranged to effect relative movement of the printheads between the first and second positions and the second actuating mechanism is arranged to interpose the capping/purging member between the printheads when the printheads are in the second position.

Optionally, the printheads are offset.

Optionally, the printer comprises a carrier positioned adjacent the printhead which carries the capping/purging member, wherein the second actuating mechanism is arranged to pivot the carrier to move the capping/purging member.

Optionally, the capping/purging member comprises a lip portion that is formed integrally with a body portion, and a cavity surrounded by the lip portion, the lip portion being peripherally configured to surround the nozzles on the printhead and the body portion having a length corresponding substantially to that of the printhead.

An illustrative embodiment of the invention is now described by way of example with reference to the accompanying drawings.

DETAILED DESCRIPTION OF EXEMPLARY EMBODIMENT

Figure 1:
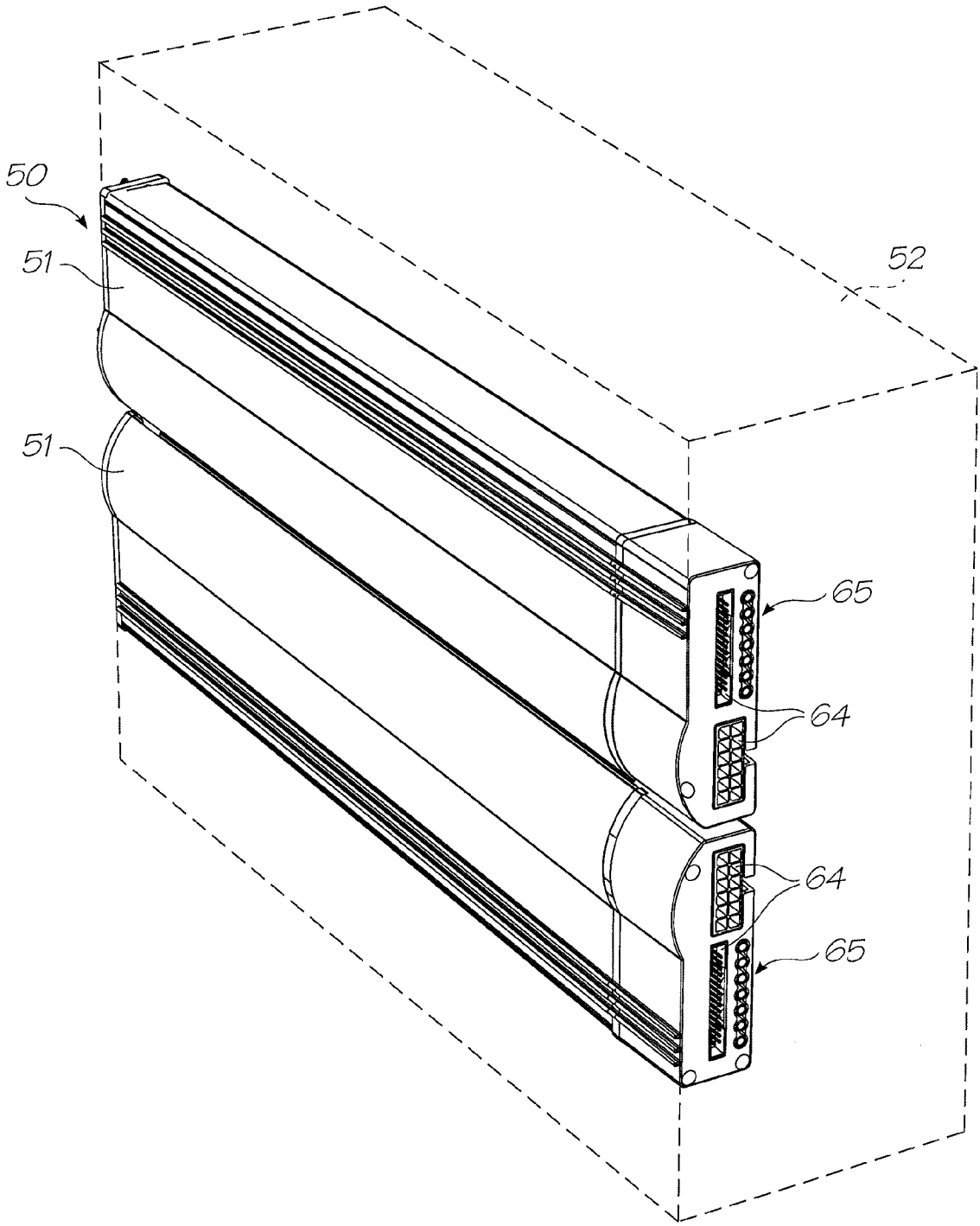
FIG. 1 shows a diagrammatic representation of a printer that incorporates a printhead assembly having two substantially identical printheads.

As illustrated in FIG. 1, a pagewidth printhead assembly 50 composed of two substantially identical pagewidth printheads 51 is mounted within a printer 52, although it will be understood from the following description that the printhead assembly might comprise a single printhead. The printer is shown in outline because it may be constituted by any one of a large number of printer types; including desk-top, office, commercial and wide format printers. Also, the printer may incorporate a single sheet feed system or a roll-feed system for print media (not shown), and it may be arranged for printing alpha-numeric, graphical or decorative images, the latter being relevant to the printing of textiles and wall coverings.

Each of the printheads 51 may, for example, be in the form of that which is described in the Applicant's co-pending U.S. patent applications listed in the cross-references section above and all of which are incorporated herein by reference. But other types of pagewidth printheads (including thermal or piezo-electric activated bubble jet printers) that are known in the art may alternatively be employed.

As illustrated in FIGS. 2 to 6 for exemplification purposes, each of the printheads 51 comprises four printhead modules 55, each of which in turn comprises a unitary arrangement of:

a) a plastics material support member 56, b) four printhead micro-electro-mechanical system (MEMS) integrated circuit chips 57 (referred to herein simply as "printhead chips"), c) a fluid distribution arrangement 58 mounting each of the printhead chips 57 to the support member 56, and d) a flexible printed circuit connector 59 for connecting electrical power and signals to each of the printhead chips 57.

However, it will be understood that each of the printheads 51 may comprise substantially more than four modules 55 and/or that substantially more than four printhead chips 57 may be mounted to each module.

Each of the chips (as described in more detail later) has up to 7680 nozzles formed therein for delivering printing fluid onto the surface of the print media and, possibly, a further 640 nozzles for delivering pressurised air or other gas toward the print media.

Figure 2:
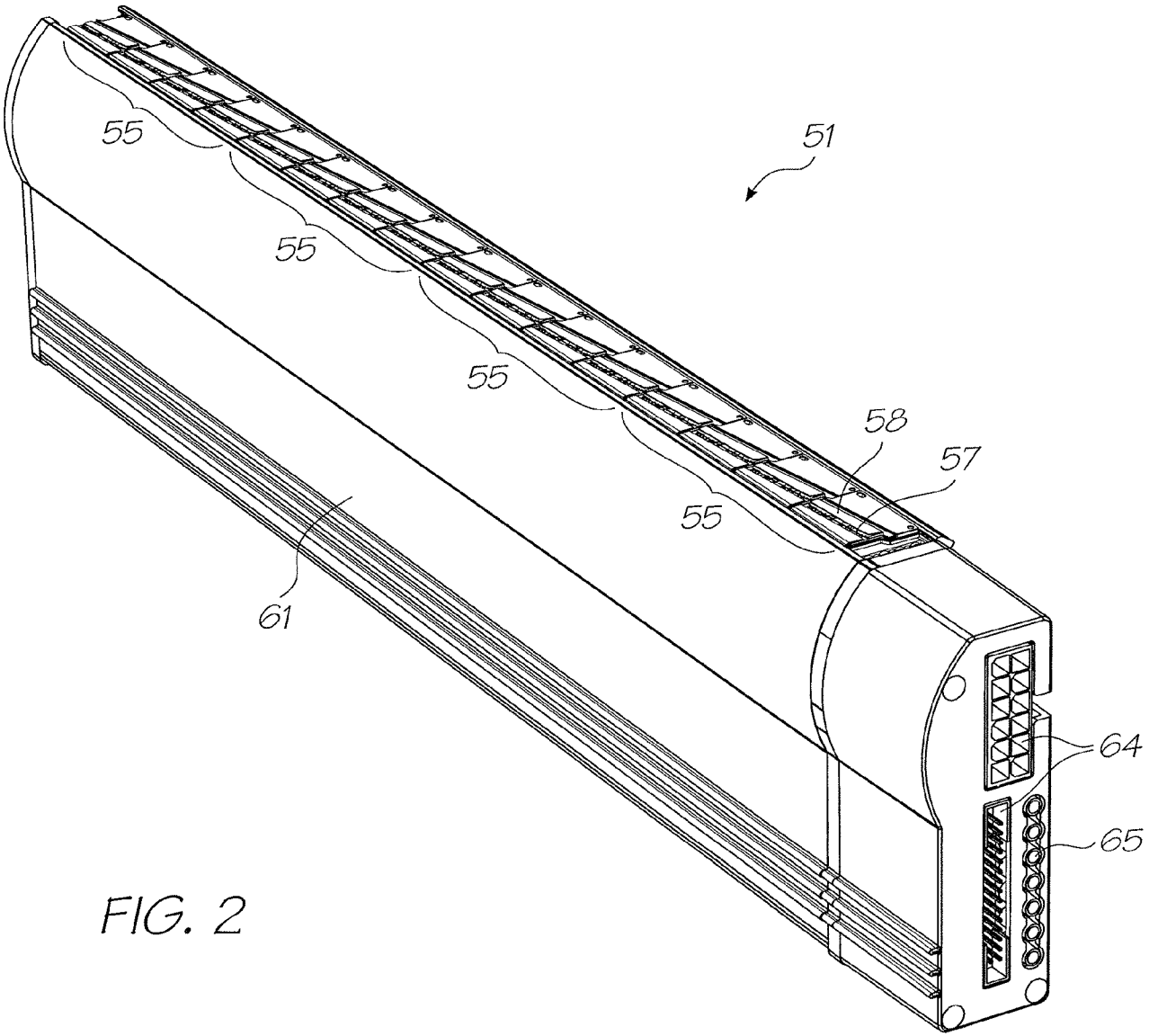
FIG. 2 shows a perspective view of one of the printheads as seen in the direction of a printing zone of the printhead.

The four printhead modules 55 are removably located in a channel portion 60 of a casing 61 by way of the support member 56, and the casing contains electrical circuitry 63 mounted on four printed circuit boards 62 (one for each printhead module 55) for controlling delivery of computer regulated power and drive signals by way of flexible PCB connectors 63*a* to the printhead chips 57. As illustrated in FIGS. 1 and 2, electrical power and print activating signals are delivered to one end of the two printheads 51 by way of conductors 64, and printing ink and air are delivered to the other end of the two printheads by fluid delivery lines 65.

The printed circuit boards 62 are carried by plastics material mouldings 66 which are located within the casing 61 and the mouldings also carry busbars 67 which in turn carry current for powering the printhead chips 57 and the electrical circuitry. A cover 68 normally closes the casing 61 and, when closed, the cover acts against a loading element 69 that functions to urge the flexible printed circuit connector 59 against the busbars 67.

The four printhead modules 55 may incorporate four conjoined support members 56 or, alternatively, a single support member 56 may be provided to extend along the full length of the printhead 51 and be shared by all four printhead modules. That is, a single support member 56 may carry all sixteen printhead chips 57.

Figure 3:
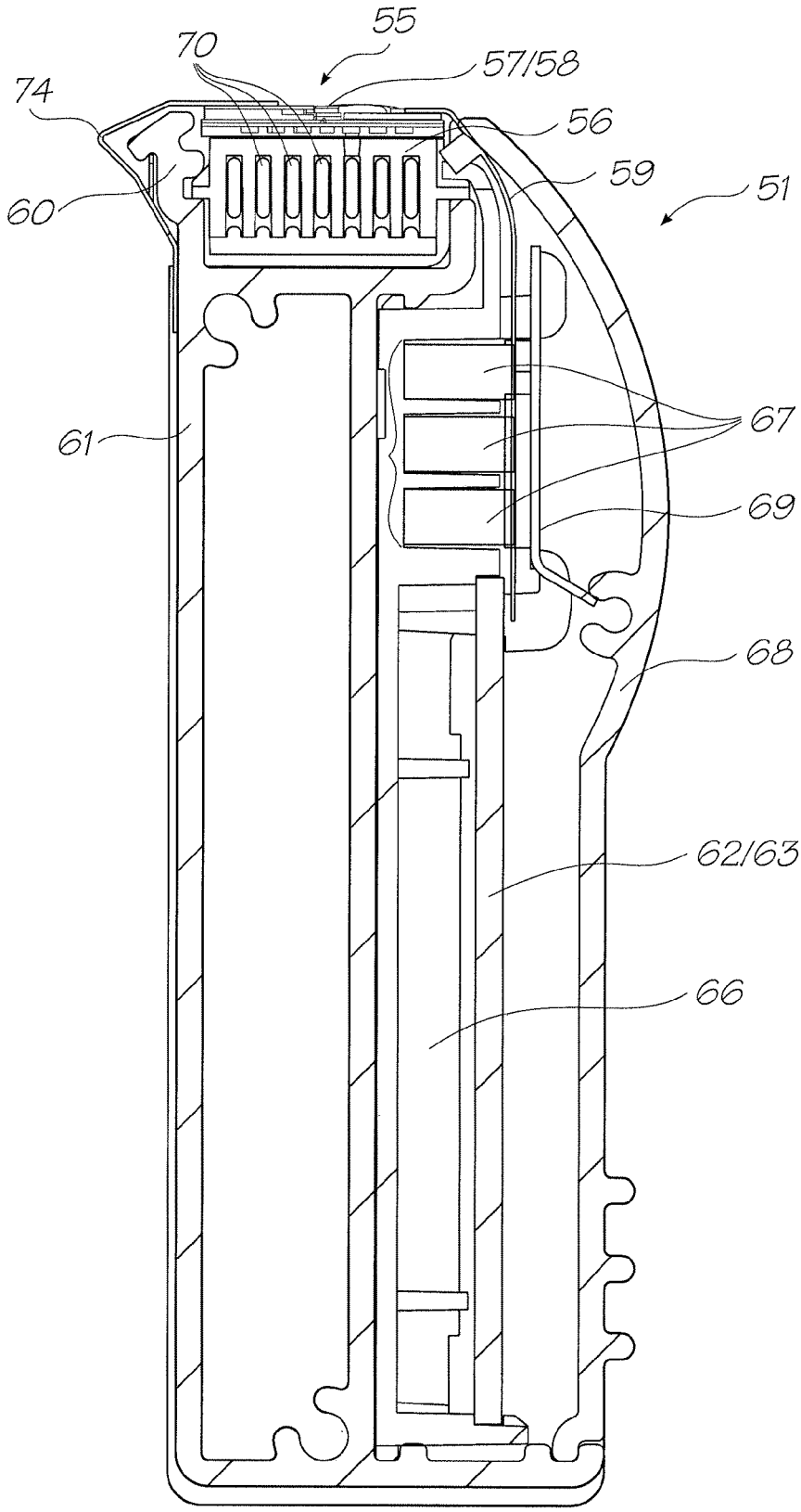
FIG. 3 shows a sectional end view of one of the printheads.
Figure 4:
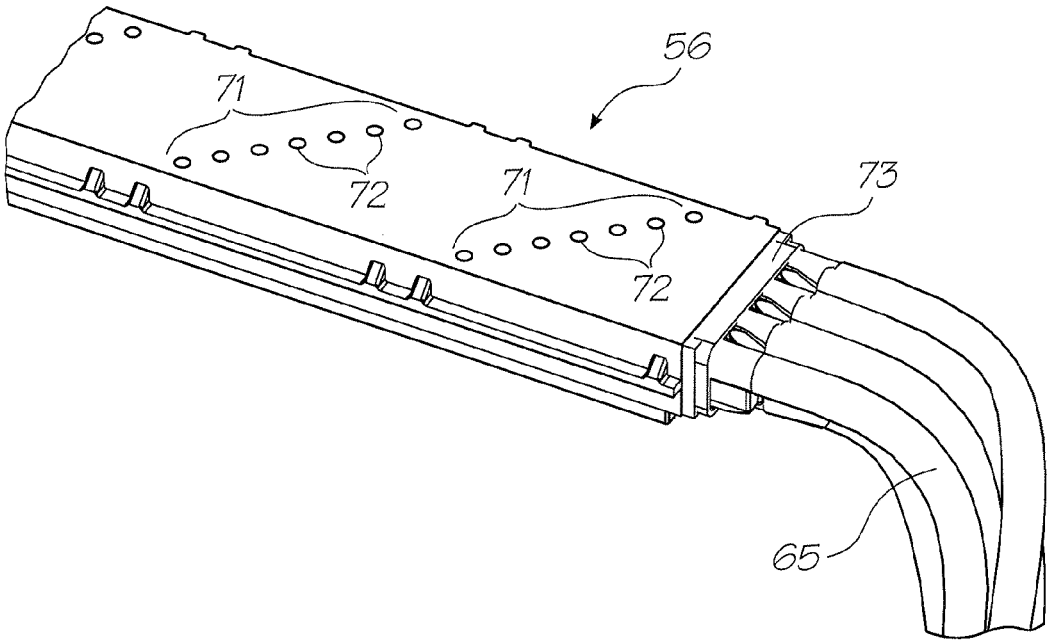
FIG. 4 shows a perspective view of an end portion of a channelled support member removed from the printhead of FIG. 3 and fluid delivery lines connected to the support member.
Figure 5:
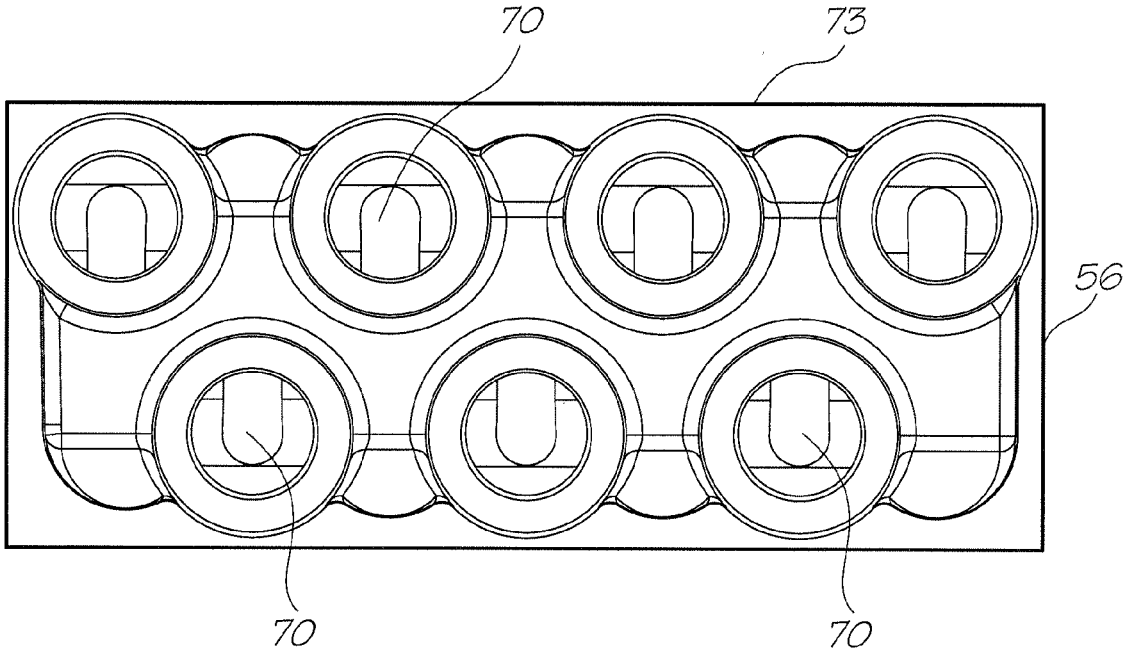
FIG. 5 shows an end view of connections made between the fluid delivery lines and the channelled support member of FIG. 4.
Figure 6:
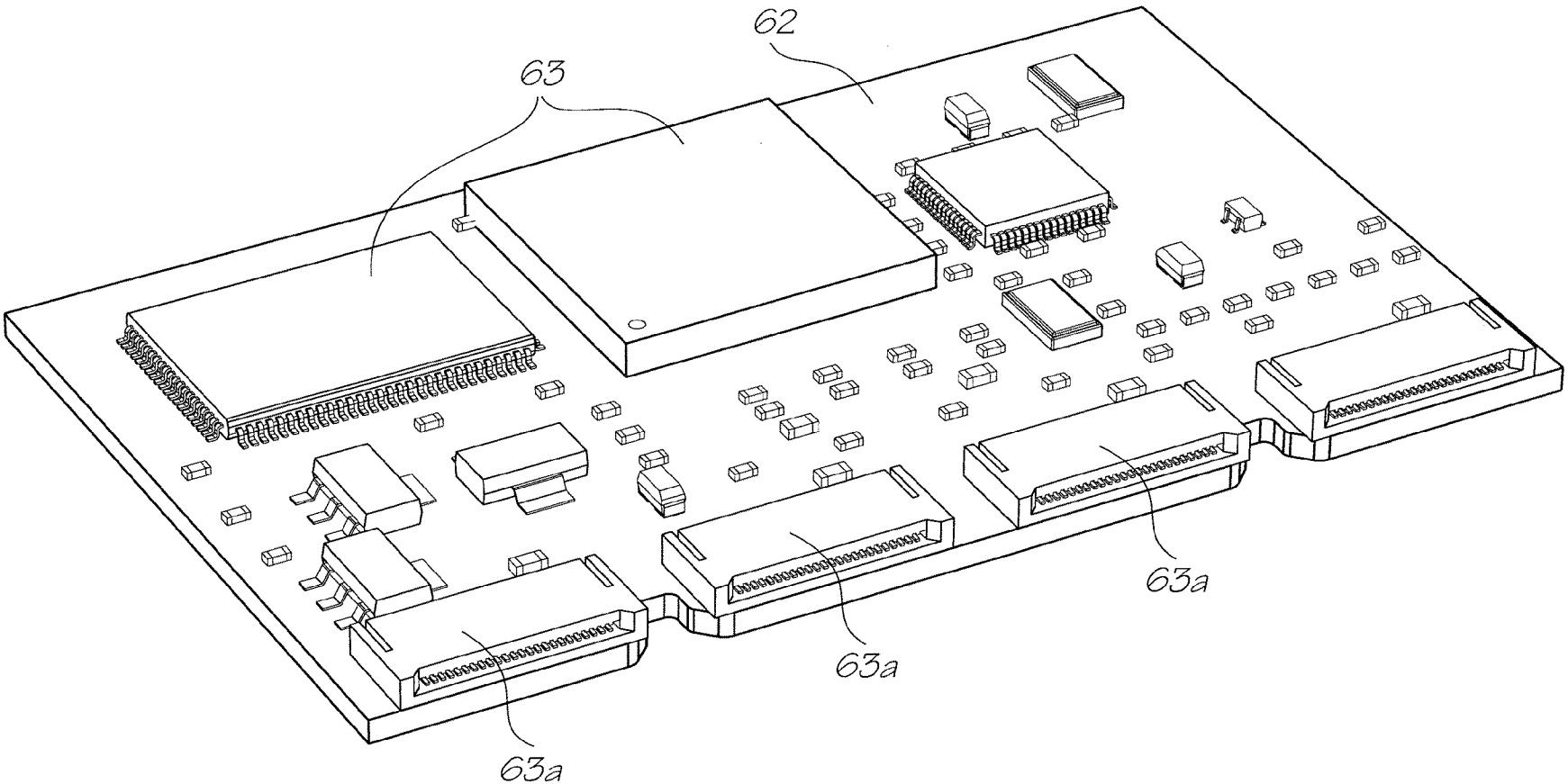
FIG. 6 shows a printed circuit board, with electronic components mounted to the board, when removed from a casing portion of the printhead of FIG. 3, FIGS. 7A, B and C show in block diagrammatic form a capping mechanism that is applicable to a printhead assembly having two printheads.

As shown in FIGS. 3 and 4, the support member 56 comprises an extrusion that is formed with seven longitudinally extending closed channels 70, and the support member is provided in its upper surface with groups 71 of millimetric sized holes. Each group comprises seven separate holes 72 which extend into respective ones of the channels 70 and each group of holes is associated with one of the printhead chips 57. Also, the holes 72 of each group are positioned obliquely across the support member 56 in the longitudinal direction of the support member.

A coupling device 73 is provided for coupling fluid into the seven channels 70 from respective ones of the fluid delivery lines 65.

The fluid distribution arrangements 58 are provided for channelling fluid (printing ink and air) from each group 71 of holes to an associated one of the printhead chips 57. Printing fluids from six of the seven channel 70 are delivered to twelve rows of nozzles on each printhead chip 57 (ie, one fluid to two rows) and the millimetric-to-micrometric distribution of the fluids is effected by way of the fluid distribution arrangements 58. For a more detailed description of one arrangement for achieving this process reference may be made to the co-pending U.S. patent applications referred to previously.

An illustrative embodiment of one printhead chip 57 is described in more detail, with reference to FIGS. 9 to 18, toward the end of this drawing-related description; as is an illustrative embodiment of a print engine controller for the printheads 51. The print engine controller is later described with reference to FIGS. 19 to 21.

A print media guide 74 is mounted to each of the printheads 51 and is shaped and arranged to guide the print media past the printing zone, as defined collectively by the printhead chips 57, in a manner to preclude the print media from contacting the nozzles of the printhead chips.

The fluids to be delivered to the printheads 51 will be determined by the functionality of the printer 52. However, as illustrated, provision is made for delivering six printing fluids and air to the printhead chips 57 by way of the seven channels 70 in the support member 56. The six printing fluids may comprise:

Cyan (C) printing ink
Magenta (M) printing ink
Yellow (Y) printing ink
Black (K) printing ink
Infrared (IR) ink
Fixative.

The filtered air will in use be delivered at a pressure slightly above atmospheric from a pressurised source (not shown) that is integrated in the printer.

Having identified the salient features of the pagewidth printheads, different aspects and embodiments will now be illustrated diagrammatically with reference to the capping arrangements shown in FIGS. 7A to 30. In the different aspects shown, the same reference numerals have been used to denote features that are similar or have some concordance with corresponding features in the other aspects.

Figure 7A:
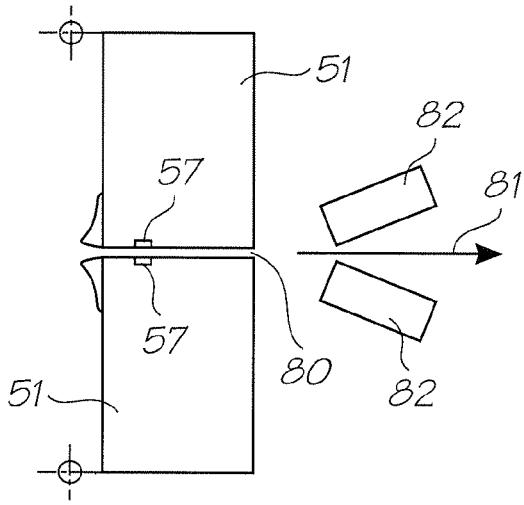

In the mechanism shown in FIG. 7A, two (duplex) printheads 51 are located adjacent one another and together define a gap 80 through which print media is transported in the direction indicated by arrow 81. However, it will be understood that the invention may be applied equally to a printer having a single printhead.

Two capping members 82 are located adjacent the printheads and are inclined at an angle of approximately 40 degrees to the direction of print media feed.

Figure 7B:
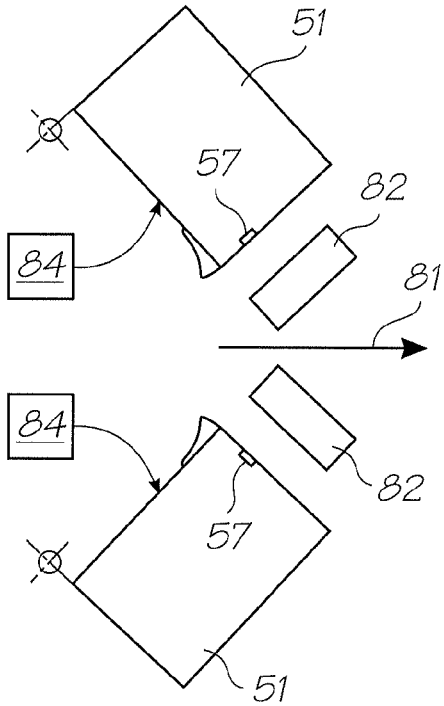

When capping is required, for example between successive print runs, the printheads 51 are turned in an arcuate direction through 40 degrees to the position shown in FIG. 7B. Thereafter, the capping members 82 are moved rectilinearly, in the directions of arrows 83, to the positions shown in FIG. 7C where the capping members are located in nozzle capping engagement with the printhead chips 57 on each of the printheads 51.

Figure 7C:
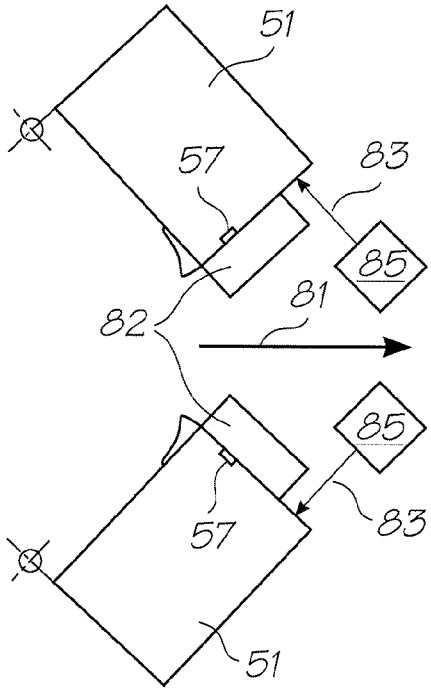

Actuating mechanisms 84 and 85, as shown in block diagrammatic form in FIGS. 7B and 7C, are employed for effecting the described movements of the printheads 51 and capping members 82. These mechanisms may comprise geared motor drives, pneumatic actuators or other such mechanisms as are known in the art for effecting movement of relatively small mechanical devices.

With the mechanism as illustrated in FIGS. 7A to 7C, the print media may be maintained in position between the printheads 51 during the capping operation. Also, the capping members 82 are moved in directions normal to the respective printheads 51, thereby avoiding any potential for rubbing between the capping members and the printing zone of the printheads.

Figure 8:
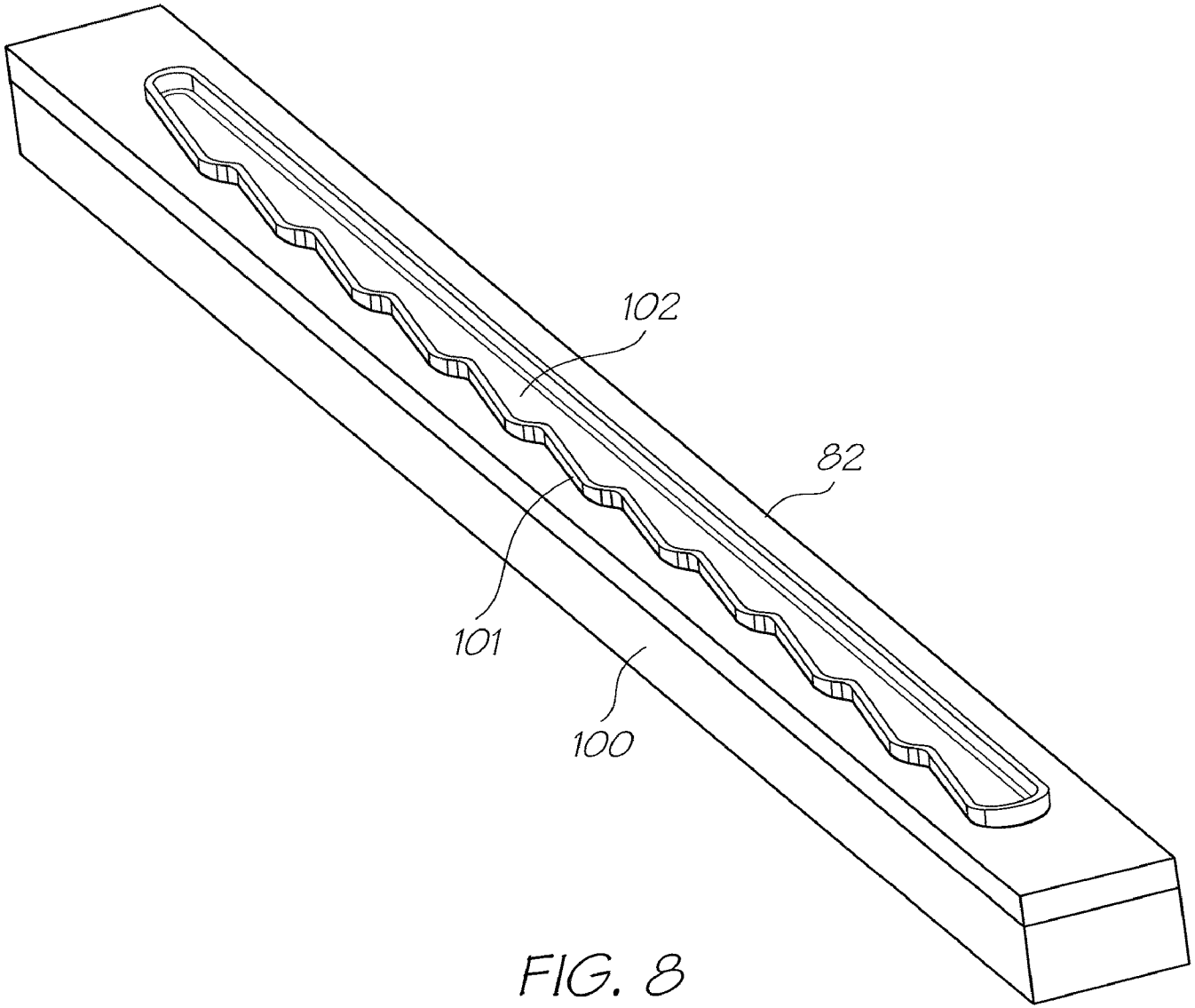
FIG. 8 shows a perspective view of a capping member of a type suitable for use in the mechanism shown in FIGS. 7A, B and C, FIGS. 9A, B and C show in block diagrammatic form a capping mechanism that is applicable to a printhead assembly having two printheads, FIGS. 10A, B and C show in block diagrammatic form a capping mechanism that is applicable to a printhead assembly having two printheads.

Each of the capping members 82 has a configuration as shown in FIG. 8 or an adaptation of that configuration. Thus, each of the capping members 82 comprises a body portion 100 and, moulded onto or otherwise secured to the body portion, a capping portion having an integrally formed lip portion 101 which surrounds a cavity 102. The body portion 100 is formed from a metal such as aluminum or from a rigid plastics material, and the capping portion (including the lip portion 101) is formed from an elastomeric material.

The lip portion 101 is peripherally configured to surround the printhead chips 57 collectively and the adjacent region of the printing zone of each or the printheads 51. Also, the cavity 102 may be provided or be lined with a hydrophobic material or a hydrophilic material, depending upon the function of the capping member and whether fluid that is purged from the printhead is to be expelled from or retained in the capping member Each of the capping members 82 may be formed as a one-piece member with a length that corresponds with that of a printhead to be capped or it may be formed from conjoined shorter-length portions that have an aggregate length corresponding to that of the printhead.

Figure 9A:
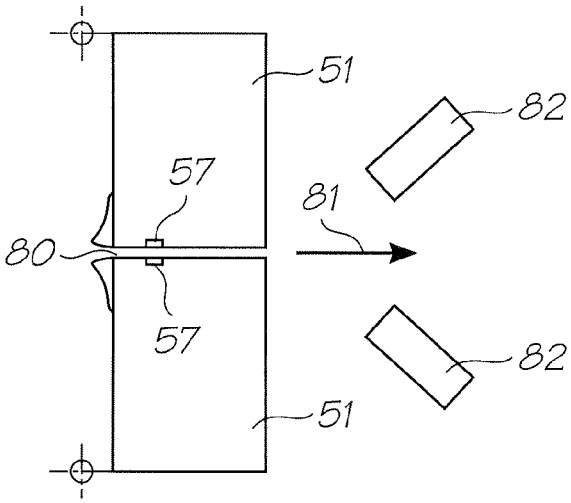

In the mechanism shown in FIG. 9A, two (duplex) printheads 51 are located adjacent one another and together define a gap 80 through which print media is transported in the direction indicated by arrow 81. However, it will be understood that the invention has equal application to a printer having a single printhead.

Two capping members 82 are located adjacent the printheads and are inclined at an angle of approximately 40 degrees to the direction of print media feed.

Figure 9B:
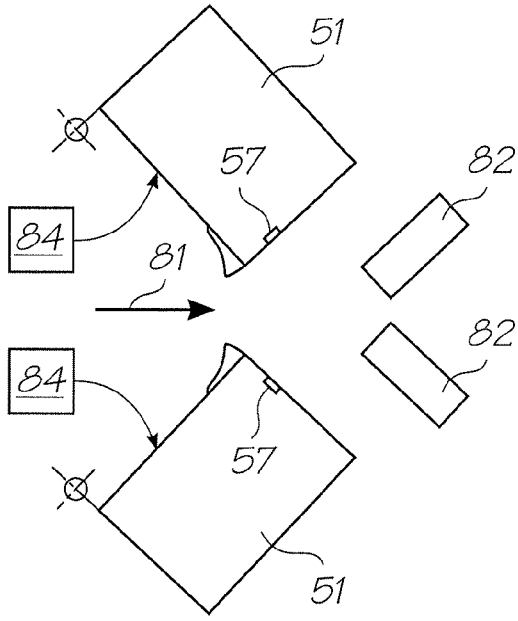

When capping is required, for example between successive print runs, the printheads 51 are turned in an arcuate direction through 40 degrees to the position shown in FIG. 9B. Thereafter, the capping members 82 are moved rectilinearly, in the lateral direction of arrows 83, to the positions shown in FIG. 9C where the capping members are located in nozzle capping engagement with the printhead chips 57 on each of the printheads 51.

Figure 9C:
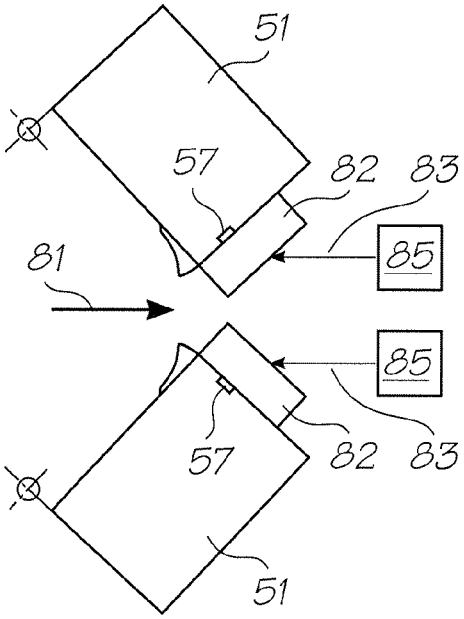

Actuating mechanisms 84 and 85, as shown in block diagrammatic form in FIGS. 9B and 9C, are employed for effecting the described movements of the printheads 51 and capping members 82. These mechanisms may comprise geared motor drives, pneumatic actuators or other such mechanisms as are known in the art for effecting movement of relatively small mechanical devices.

With the mechanism as illustrated in FIGS. 9A to 9C, the print media may be maintained in position between the printheads 51 during the capping operation.

Each of the capping members 82 has a configuration as shown in FIG. 8 described in detail above.

Figure 10A:
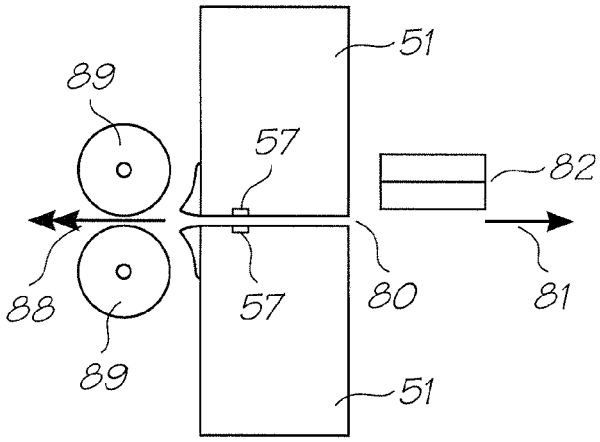

In the mechanism shown in FIG. 10A, two (duplex) printheads 51 are positioned one above the other to define a gap 80 through which print media is passed, in the direction of arrow 88, during a printing operation. A single capping member 82 having opposed capping faces 86 is positioned adjacent the printing heads and slightly above the path of the print media.

Figure 10B:
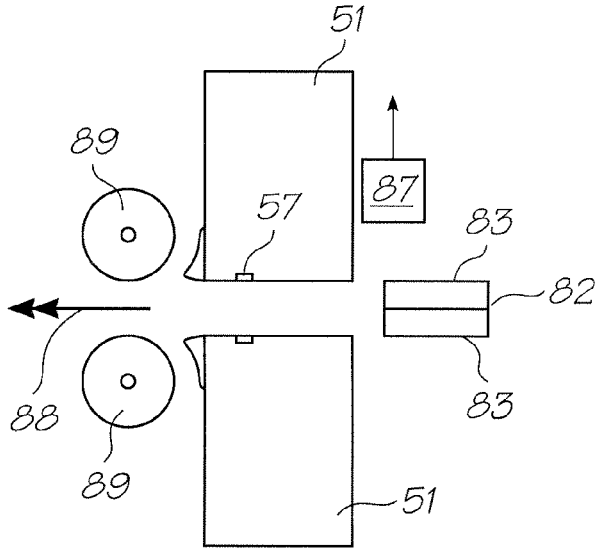

When capping is required, any print media that is positioned in the printer is moved in the direction of arrow 88 by rollers 89 and the upper printhead 51 is raised (relative to the lower printhead) by an actuating mechanism 87, as indicated in FIG. 10B. The capping member 82 is then moved rectilinearly by an actuating mechanism 90 to the position shown in FIG. 10C, where it is interposed between the printheads 51 and located in nozzle capping engagement with the printhead chips 57 on both of the printheads. Positive engagement between the capping member 82 and the two printheads is effected by lowering the upper printhead 51 onto the capping member 82.

Figure 10C:
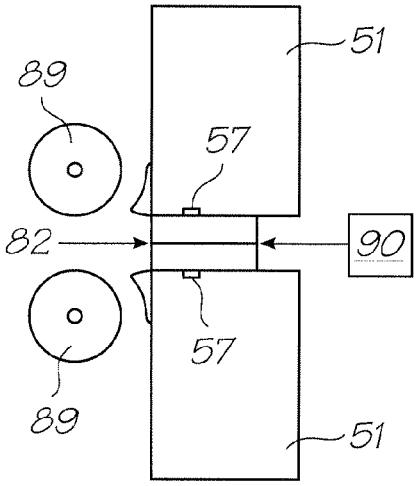

The actuating mechanisms 87 and 90, as shown in block diagrammatic form in FIGS. 10B and 10C and as employed for effecting the described movements of the printheads 51, may comprise geared motor drives, pneumatic actuators or other such mechanisms as are known in the art for effecting movement of relatively small mechanical devices.

Figure 11:
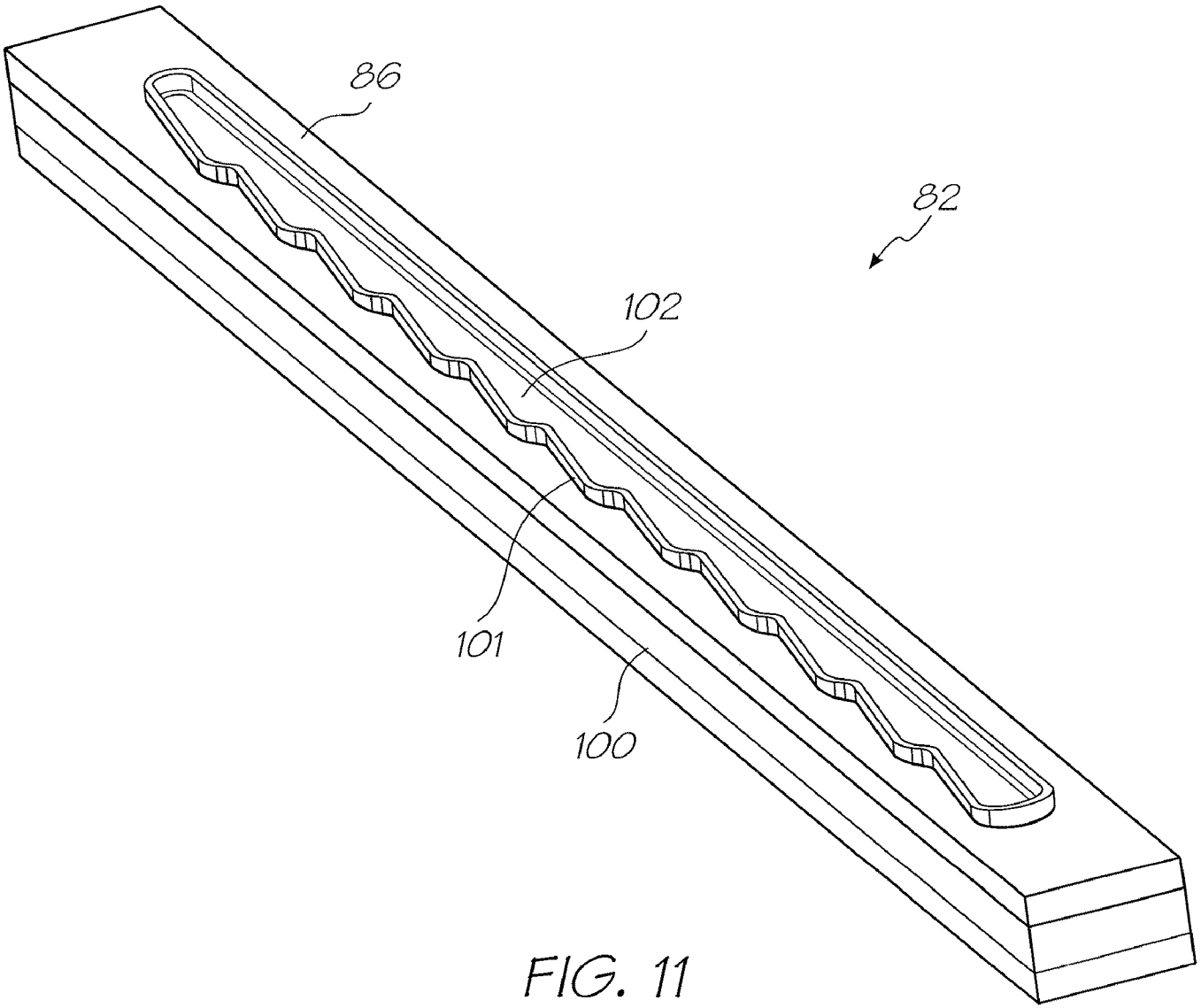
FIG. 11 shows a perspective view of a capping member of a type suitable for use in the mechanisms shown in FIGS. 10A, B and C, FIGS. 12A and B show in block diagrammatic form a capping mechanism that is applicable to a printhead assembly having a single (Simplex) printhead, FIGS. 13A and B show in block diagrammatic form a capping/purging mechanism that is applicable to a printhead assembly having a single (Simplex) printhead, FIGS. 14A and B show in block diagrammatic form a capping mechanism that is applicable to a printhead assembly having an offset duplex printhead arrangement, FIGS. 15A and B show in block diagrammatic form a capping mechanism that is applicable to a printhead assembly having a single (Simplex) printhead, FIGS. 16A and B show in block diagrammatic form a capping/purging mechanism that is applicable to a printhead assembly having a single (Simplex) printhead, FIGS. 17A, B and C show in block diagrammatic form a capping mechanism that is applicable to a printhead assembly having two printheads, FIGS. 18A, B, C and D show in block diagrammatic form a capping/purging mechanism that is applicable to a printhead assembly having two pagewidth printheads.

The capping member 82 is double sided, having in effect two capping portions 86, and has a configuration as shown in FIG. 11. Thus, the capping member 82 comprise a body portion 100 and, moulded onto or otherwise secured to upper and lower faces of the body portion, a capping portion having an integrally formed lip portion 101 which surrounds a cavity 102. The body portion 100 is formed from a metal such as aluminum or from a rigid plastics material, and the capping portion (including the lip portion 101) is formed from an elastomeric material.

The lip portion 101 is peripherally configured to surround the printhead chips 57 collectively and the adjacent region of the printing zone of each or the printheads 51. Also, the cavity 102 may be provided or be lined with a hydrophobic material or a hydrophilic material, depending upon the function of the capping member and whether fluid that is purged from the printhead is to be expelled from or retained in the capping member.

The capping member 82 may be formed, effectively, as a one-piece member with a length that corresponds with that of the printhead to be capped or it may be formed from conjoined shorter-length portions that have an aggregate length corresponding to that of the printhead.

Figure 12A:
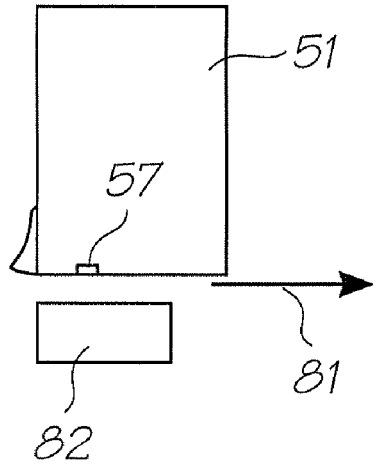

FIGS. 12A and B illustrate a capping mechanism that is appropriate to a printer having a single (simplex) printing head 51.

Figure 12B:
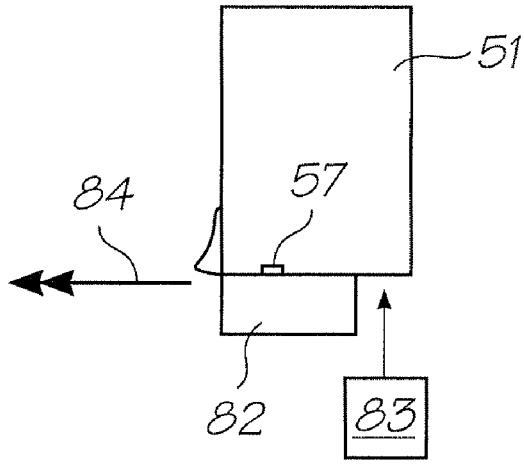

As illustrated, a capping member 82 is initially located below the plane of print media feed 81 through the printer and, following the extraction of any print media in the direction indicated by arrow 84, the capping member is moved rectilinearly upward by an actuating mechanism 83 to the position shown in FIG. 12B where it is located in nozzle capping engagement with the printhead chips 57 on the printhead 51.

The actuating mechanism 83 may comprise a geared motor drive, pneumatic actuator or other such mechanism as is known in the art for effecting movement of relatively small mechanical devices.

The capping member 82 is moved in a direction normal to the printhead 51, thereby avoiding any potential for rubbing between the capping member and the printing zone of the printhead.

The capping member 82 has a configuration as shown in FIG. 8 described in detail above.

Figure 13A:
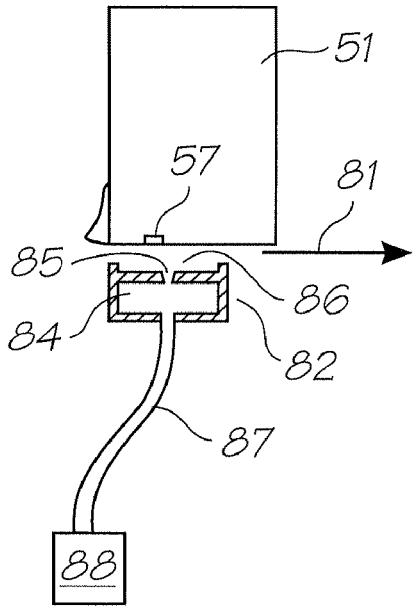

FIGS. 13A and B illustrate a capping/purging mechanism that is appropriate to a printer having a single (simplex) printing head 51.

Figure 13B:
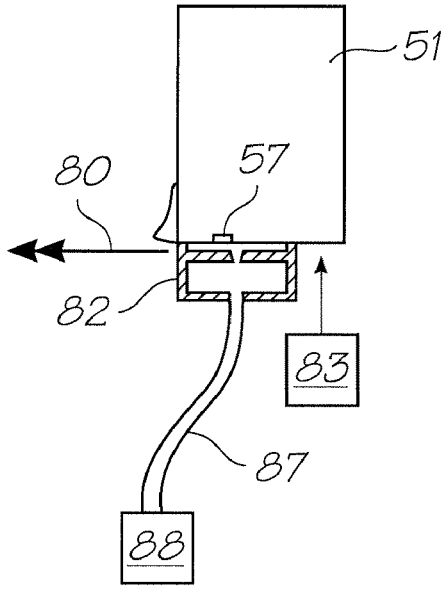

As illustrated, a capping member 82 is initially located below the plane of print media feed 81 through the printer and, following the extraction of any print media in the direction indicated by arrow 80, the capping member is moved rectilinearly upward by an actuating mechanism 83 to the position shown in FIG. 13B where it is located in nozzle capping engagement with the printhead chips 57 on the printhead 51.

The actuating mechanism 83 may comprise a geared motor drive, pneumatic actuator or other such mechanism as is known in the art for effecting movement of relatively small mechanical devices.

The capping member 82 doubles as a purging member and it incorporates a chamber 84 that communicates by way of a port 85 with a cavity 86. An extractor tube 87 extends into the chamber 84 and is connected to a suction pump or other such device 88 within the printer for sucking purged material from the nozzle environment of the printhead 51.

The capping member 82 is moved by the actuating mechanism 83 in a direction normal to the printhead 51, thereby avoiding potential for rubbing between the capping member and the printing zone of the printhead.

The capping member 82 has a configuration as shown in FIG. 8 described in detail above.

Figure 14A:
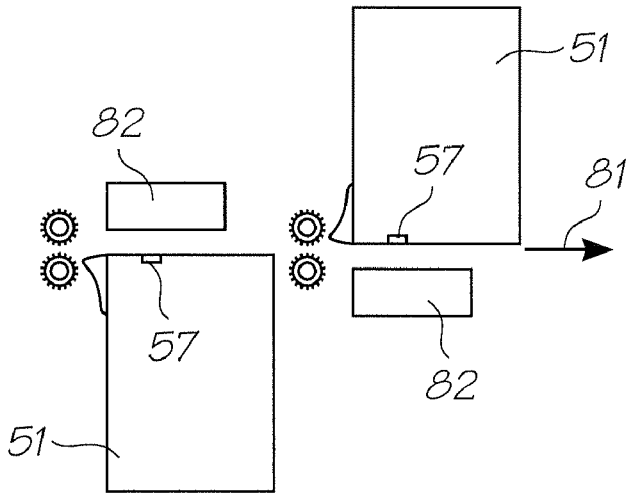
Figure 14B:
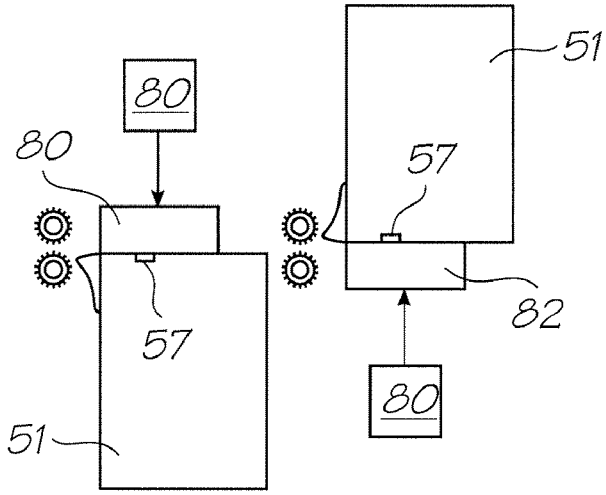

FIGS. 14A and B illustrate a capping mechanism that is appropriate to a printer having two (Duplex) offset printheads 51. The printheads are orientated in mutually opposite directions and are arranged to deliver ink onto opposite faces of print media as it is transported between the printheads As illustrated, capping members 82 are initially located in vertical spaced relationship to the respective printheads 51 and, thus, are located one at each side of the plane 81 of print media feed through the printer. Following the extraction of any print media from between the printheads 51, the capping members are moved rectilinearly in mutually opposite vertical directions by actuating mechanisms 80, to the positions shown in FIG. 14B, where they are located in nozzle capping engagement with the printhead chips 57 on the respective printheads 51.

Each of the actuating mechanisms 80 may comprise a geared motor drive, pneumatic actuator or other such mechanism as is known in the art for effecting movement of relatively small mechanical devices.

The capping members 82 are moved in a direction normal to the printheads 51, thereby avoiding any potential for rubbing between the capping members and the printing zone of the printheads.

Each of the capping members 82 has a configuration as shown in FIG. 8 described in detail above.

Figure 15A:
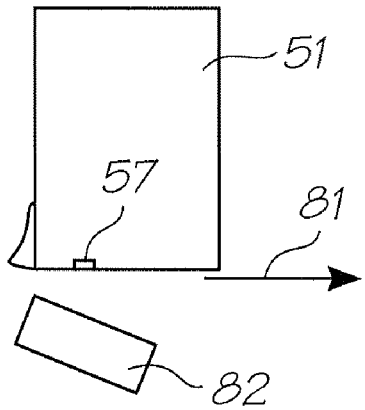

FIGS. 15A and B illustrate a capping mechanism that is appropriate to a printer having a single (simplex) printing head 51.

Figure 15B:
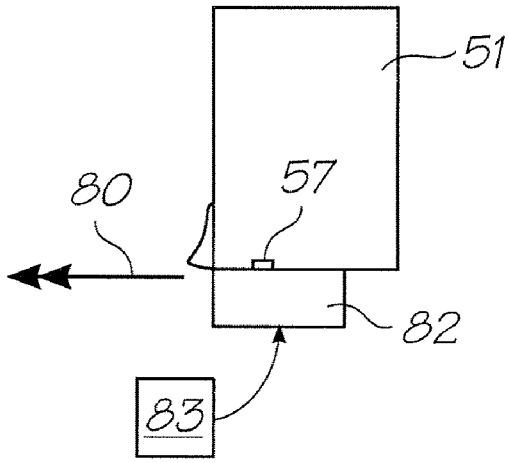

As illustrated, a capping member 82 is initially located below the plane of print media feed 81 through the printer and, following the extraction of any print media in the direction indicated by arrow 80, the capping member is moved arcuately upwardly by an actuating mechanism 83 to the position shown in FIG. 15B where it is located in nozzle capping engagement with the printhead chips 57 on the printhead 51.

The actuating mechanism 83 may comprise a geared motor drive, pneumatic actuator or other such mechanism as is known in the art for effecting movement of relatively small mechanical devices.

The capping member 82 is moved in a direction approximately normal to the printhead 51, thereby avoiding any potential for significant rubbing between the capping member and the printing zone of the printhead.

The capping member 82 has a configuration as shown in FIG. 8 described in detail above.

Figure 16A:
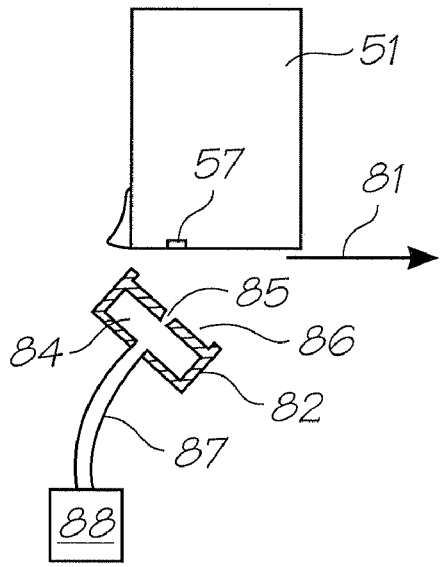

FIGS. 16A and B illustrate a capping/purging mechanism that is appropriate to a printer having a single (simplex) printing head 51.

Figure 16B:
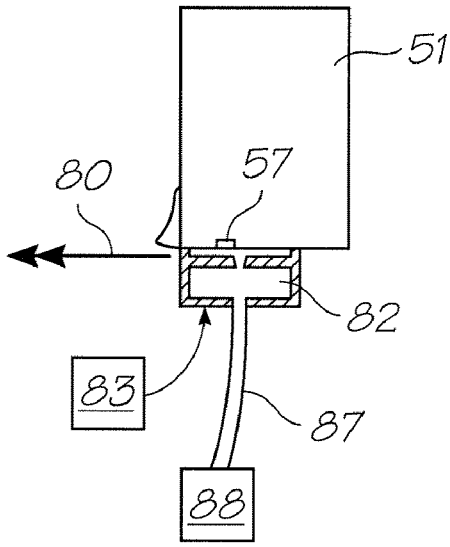

As illustrated, a capping member 82 is initially located below the plane 81 of print media feed through the printer and, following the extraction of any print media in the direction indicated by arrow 80, the capping member is moved arcuately in an upward by an actuating mechanism 83 to the position shown in FIG. 16B where it is located in nozzle capping engagement with the printhead chips 57 on the printhead 51.

The actuating mechanism 83 may comprise a geared motor drive, pneumatic actuator or other such mechanism as is known in the art for effecting movement of relatively small mechanical devices.

The capping member 82 doubles as a purging member and it incorporates a chamber 84 that communicates by way of a port 85 with a cavity 86. An extractor tube 87 extends into the chamber 84 and is connected to a suction pump or other such device 88 within the printer for sucking purged material from the nozzle environment of the printhead 51.

The capping member 82 is moved by the actuating mechanism 83 in a direction that is approximately normal to the printhead 51, thereby avoiding potential for significant rubbing between the capping member and the printing zone of the printhead.

Each of the capping members 82 has a configuration as shown in FIG. 8 described in detail above.

Figure 17A:
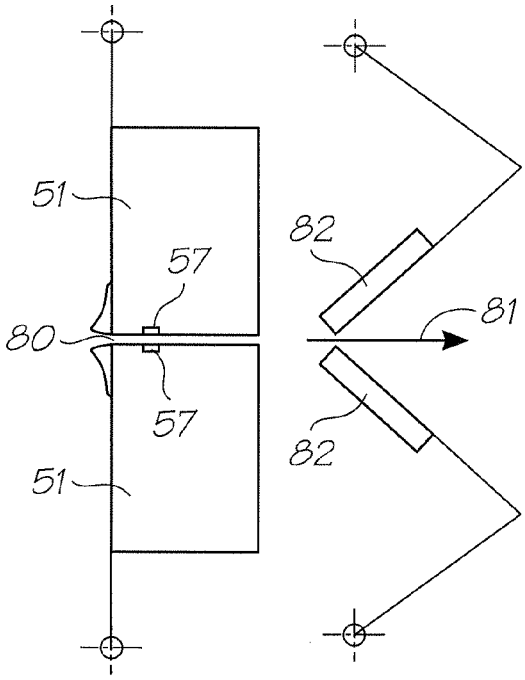

In the mechanism shown in FIG. 17A, two (duplex) printheads 51 are located adjacent one another and together define a gap 80 through which print media is transported in the direction indicated by arrow 81. However, it will be understood that the invention may be applied equally to a printer having a single printhead.

Two capping members 82 are located adjacent the printheads and are inclined at an angle of approximately 40 degrees to the direction of print media feed.

Figure 17B:
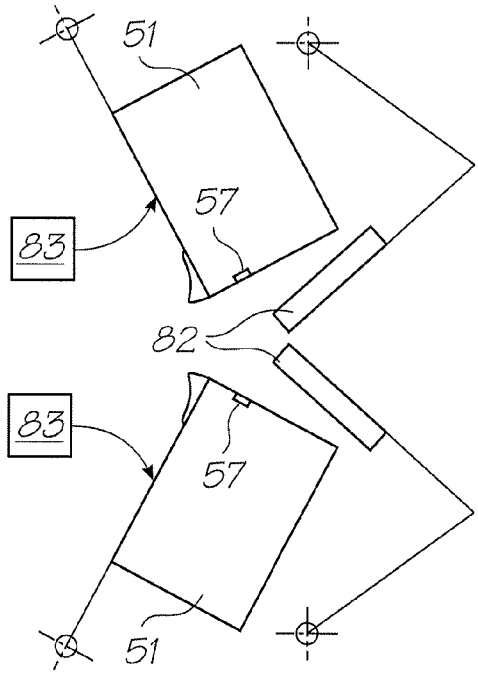

When capping is required, for example between successive print runs, the printheads 51 are turned in an arcuate first direction through 40 degrees to the position shown in FIG. 17B. Thereafter, the capping members 82 are turned in an arcuate second direction, that is opposite to that of the first direction, to the positions shown in FIG. 17C where the capping members are located in nozzle capping engagement with the printhead chips 57 on each of the printheads 51.

Figure 17C:
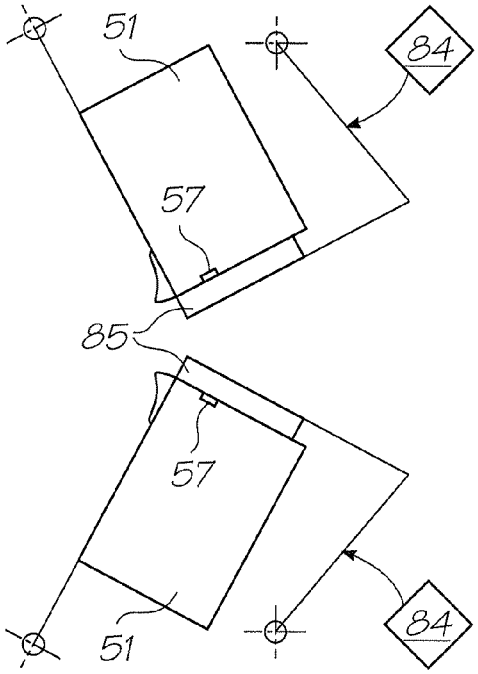

Actuating mechanisms 83 and 84, as shown in block diagrammatic form in FIGS. 17B and 17C, are employed for effecting the described movements of the printheads 51 and capping members 82. These mechanisms may comprise geared motor drives, pneumatic actuators or other such mechanisms as are known in the art for effecting movement of relatively small mechanical devices.

With the mechanism as illustrated in FIGS. 17A to 17C, the print media may be maintained in position between the printheads 51 during the capping operation.

Each of the capping members 82 has a configuration as shown in FIG. 8 described in detail above.

In the mechanism shown in FIG. 18A to D, two (duplex) printheads 51 are located adjacent one another and together define a gap 80 through which print media is transported in the direction indicated by arrow 81. Two capping/purging members 82 are located adjacent the printheads and are inclined with respect to the direction of print media feed.

Figure 18A:
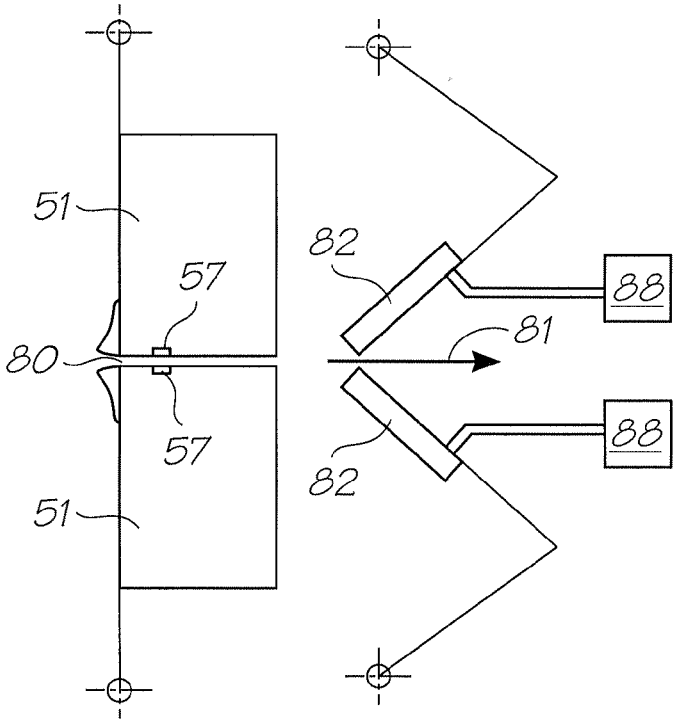
Figure 18B:
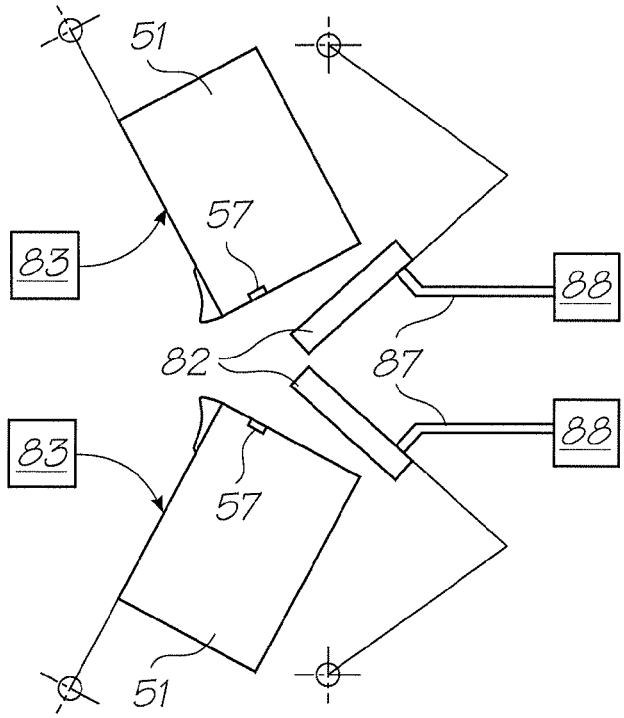

When capping is required, for example between successive print runs, the printheads 51 are turned in an arcuate first direction from a non-capping first position to a second position as shown in FIG. 18B.

Figure 18C:
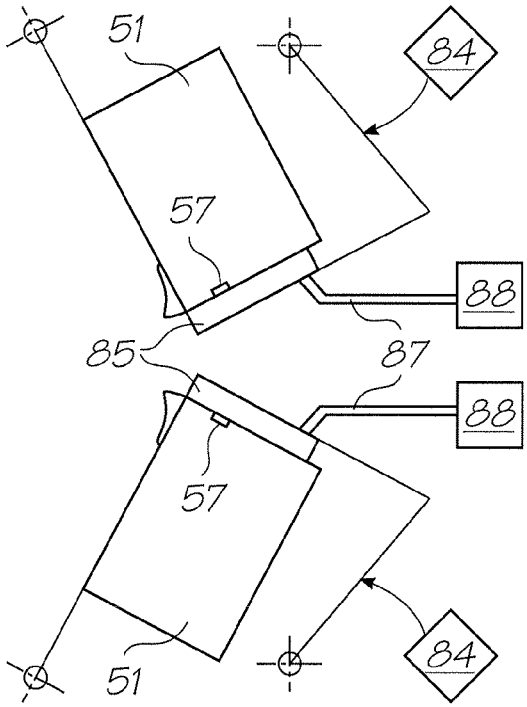

Thereafter, the capping/purging members 82 are turned in an arcuate second direction, opposite to that of the first direction, through to the second position shown in FIG. 18C. In this second position capping portions 85 of the capping/purging members 82 are located in nozzle capping engagement with the printhead chips 57 on each of the printheads 51.

Figure 18D:
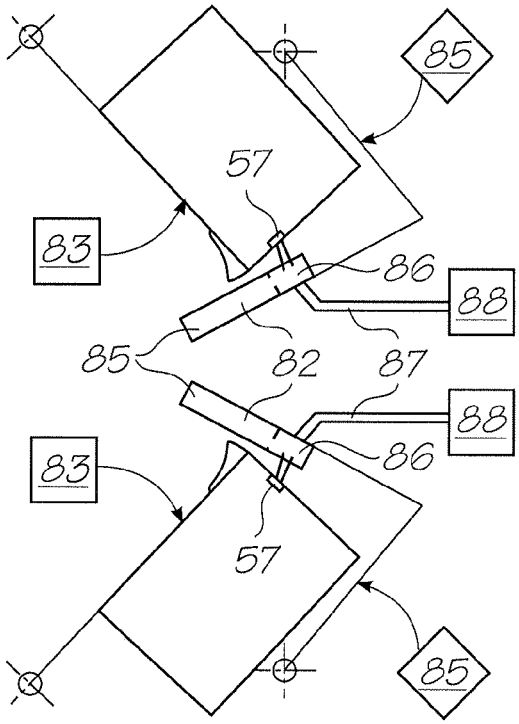

Actuating mechanisms 83 and 84, as shown in block diagrammatic form in FIGS. 18B to 18D, are employed for effecting the described movements of the printheads 51 and the capping/purging members 82. These actuating mechanisms may comprise geared motor drives, pneumatic actuators or other such mechanisms as are known in the art for effecting movement of relatively small mechanical devices.

The capping/purging member 82 incorporates a purging chamber 86 (see FIG. 18D) that is arranged to receive material that is purged from the nozzles in the printing head chips 57. An extractor tube 87 extends into the chamber 86 and is connected to a suction pump or other such device 88 within the printer 52 for sucking material that is purged from the nozzle environment of the printhead.

If purging is required following capping of the printhead chips 57 on the printheads 51, the printheads 51 are turned in the first direction through a further angle, as shown in FIG. 18D, to a third position. At this third position the printhead chips 57 are located adjacent the chambers 86 and purging of the nozzles is effected.

If purging is required independently of capping, the printheads 51 will be turned though the full extent from the first to the third position by the actuating mechanisms 83, and the capping/purging members 82 will be turned in the opposite direction by the actuating mechanisms 84, so that the printhead chips 57 will align with the purging chambers 86.

The capping and/or purging operations may be performed in the above described apparatus without interfering with the movement of print media. Thus, the print media may be maintained in position between the printheads 51 during the capping and purging operation.

Figure 19:
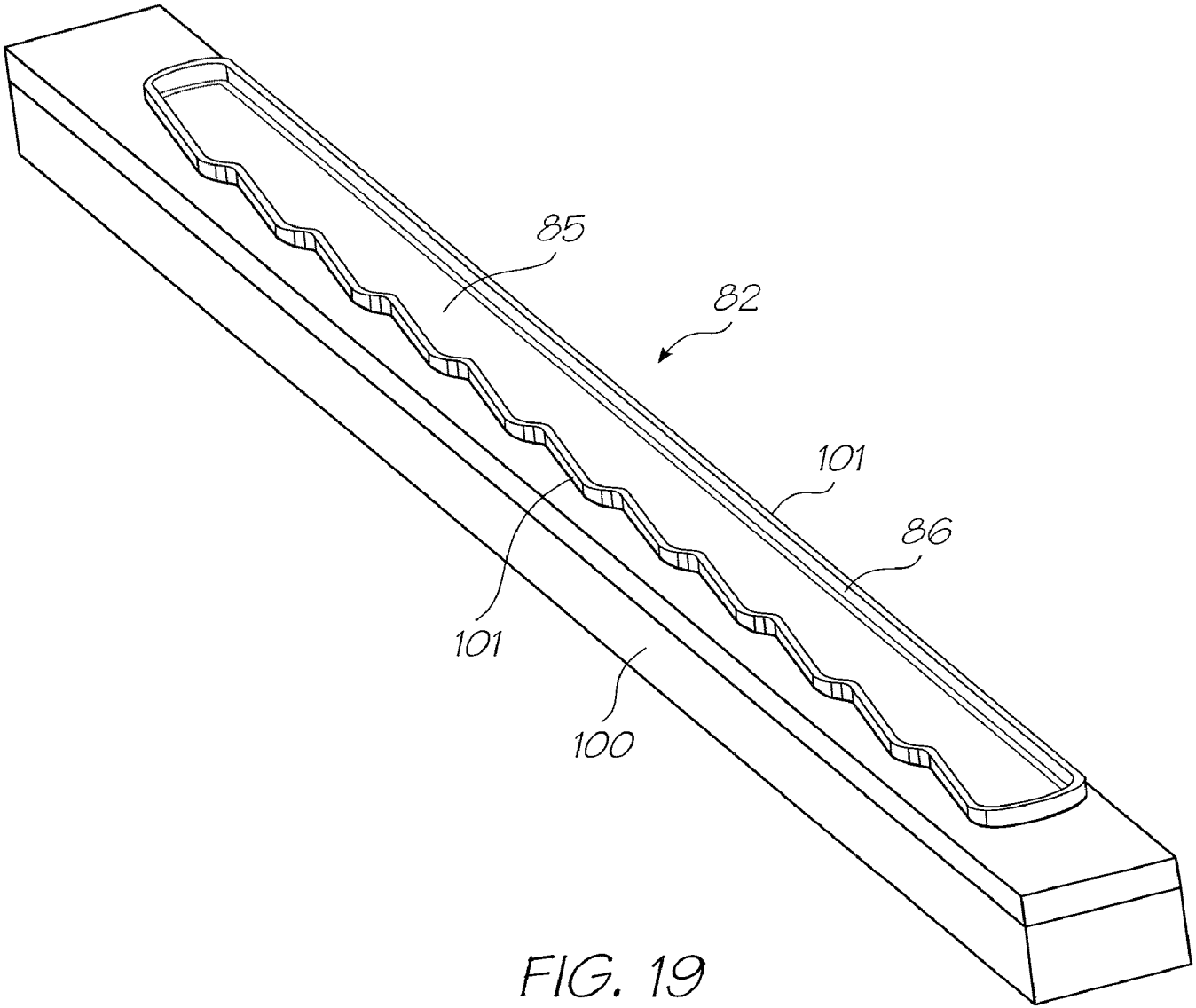
FIG. 19 shows a perspective view of a capping/purging member of a type suitable for use in the mechanism shown in FIGS. 18A to D, FIGS. 20A and B show in block diagrammatic form a turret mounted capping/purging mechanism that is applicable to a printhead assembly having a single printhead.

Each of the capping/purging members 82 has a configuration as shown in FIG. 19. Thus, each of the capping/purging members 82 comprises a body portion 100 and, moulded onto or otherwise secured to the body portion, a capping portion having an integrally formed lip portion 101 which surrounds the cavity 85 and the purging chamber 86. The body portion 100 is formed from a metal such as aluminum or from a rigid plastics material, and the capping portion (including the lip portion 101) is formed from an elastomeric material.

The lip portion 101 is peripherally configured to surround the printhead chips 57 collectively and the adjacent region of the printing zone of each or the printheads 51 during both the capping and the purging operations.

Each of the capping/purging members 82 may be formed as a one-piece member with a length that corresponds with that of a printhead to be capped or it may be formed from conjoined shorter-length portions that have an aggregate length corresponding to that of the printhead.

Figure 20A:
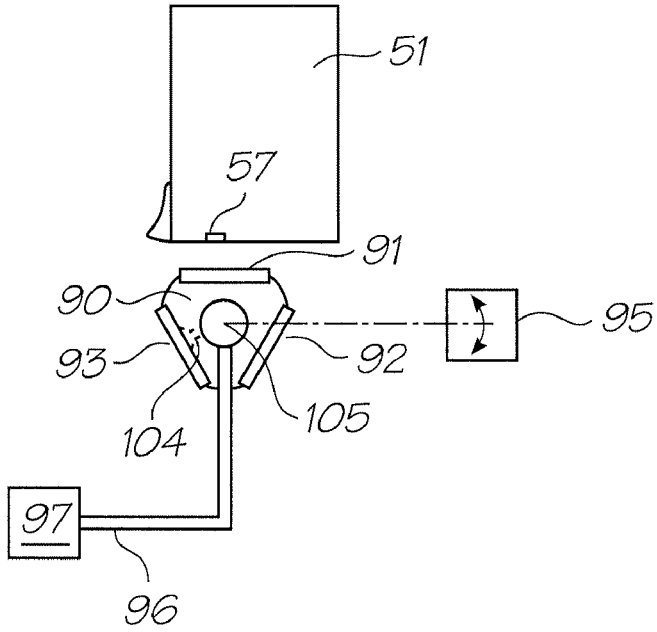
Figure 20B:
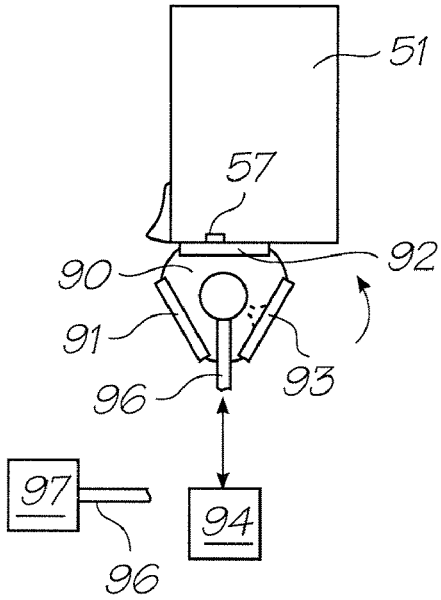

The mechanism that is illustrated in FIGS. 20A and B comprises a rotatable turret 90 that is positioned vertically below a single printhead 51, although it will be understood that two turrets might be employed in association with two arcuately moveable printheads if a duplex printhead assembly were to be employed. The turret 90 has a generally triangular configuration in cross-section and it extends (into the page as illustrated) for substantially the full longitudinal length of the printhead 51. The turret carries a platen 91, a capping portion 92 and a purging chamber 93 on its respective faces.

When positioned adjacent (ie, just below) the printing head 51, the platen 91 provides support for normal print media feed through the printer. When capping and/or purging is required, the turret 90 is initially lowered by a first actuating mechanism 94 and is rotated by a second actuating mechanism 95 to position the capping member 92 or the purging chamber 93 in alignment with the printhead 51. Thereafter, the turret is again raised by the actuating mechanism 94 to the position shown in FIG. 20B.

When the purging chamber 96 is located in contact with the printhead chips 57, purging may be effected and the purged material be sucked out by way of an extractor tube 96 that is connected to a suction device 97, such as a pump, in the printer.

The actuating mechanisms 94 and 95, as shown in block diagrammatic form, may comprise geared motor drives, pneumatic actuators or such other mechanisms as are known in the art for effecting movement of relatively small mechanical devices.

Figure 21:
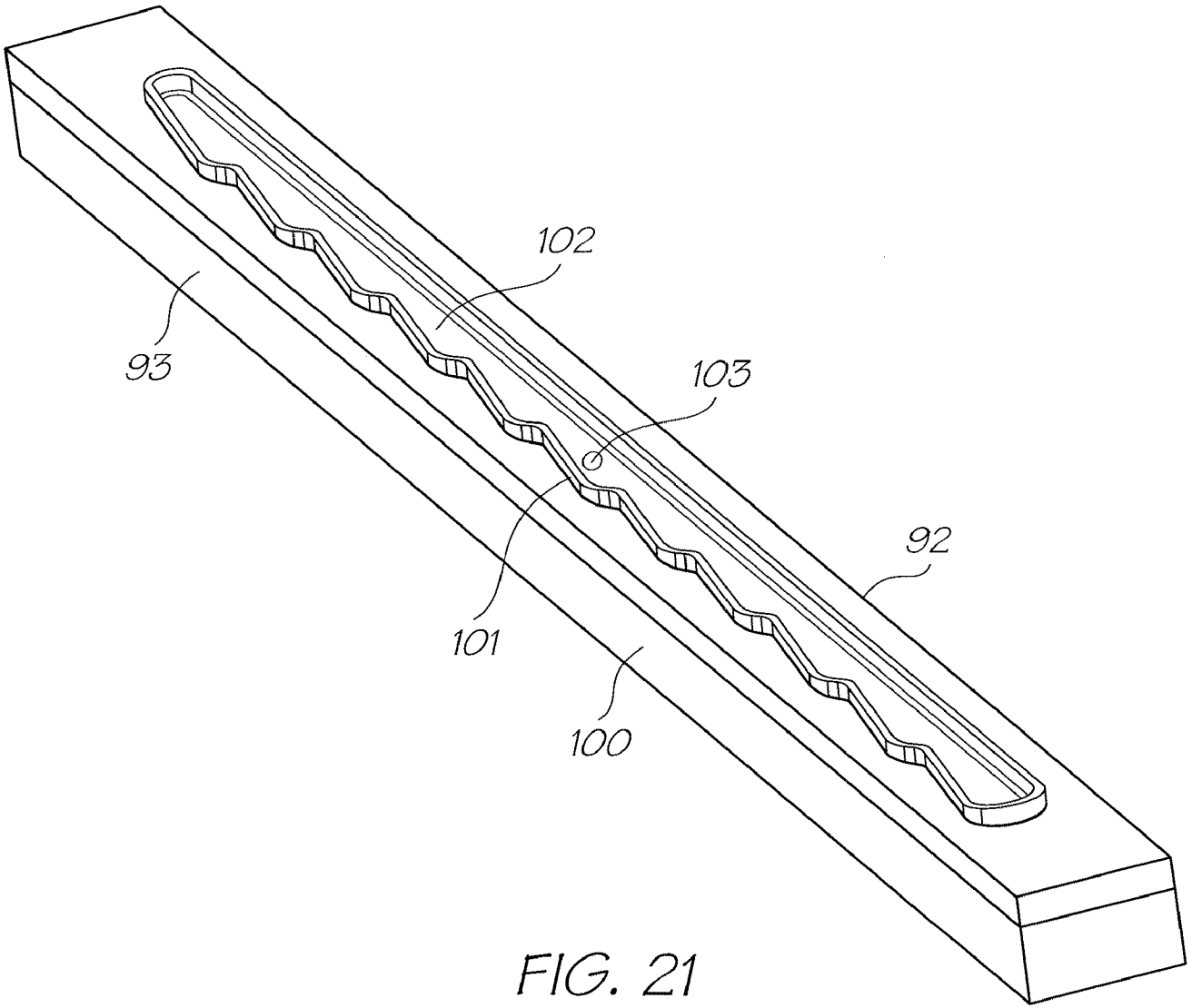
FIG. 21 shows a perspective view of a capping member of a type suitable for use in the mechanism shown in FIGS. 20A and B, FIGS. 22A and B show in block diagrammatic form a turret mounted capping/purging mechanism that is applicable to a printhead assembly having a single printhead.

The capping member 92 and the purging chamber 93 as mounted to the turret 90 may each have the configuration as illustrated in FIG. 21. The illustrated member in each case comprises a body portion 100 and, moulded onto or otherwise secured to the body portion, a capping portion or purging chamber having an integrally formed lip portion 101 that surrounds a cavity 102. The body portion 100 is formed from a metal such as aluminum or from a rigid plastics material, and the capping or purging portion (including the lip portion 101) is formed from an elastomeric material.

The lip portion 101 is peripherally configured to surround the printhead chips 57 collectively and the adjacent region of the printing zone of each or the printheads 51. In the case of the purging chamber 93, an aperture 103 is provided (or a plurality of such apertures are provided) in the cavity 102 to connect with the extractor tube 96 by way of a port 104 and a central bore 105 of the turret 90.

The capping member/purging chamber 92/93 may be formed as a one-piece member with a length that corresponds with that of the printhead 51 to be capped or it may be formed from conjoined shorter-length portions that have an aggregate length corresponding to that of the printhead.

As an alternative to the use of the purging chamber 93, the nozzles 57 may be purged directly into an aperture or a ported recess (herein referred to as a purging chamber) in the turret when the turret is rotated to the appropriate position.

Figure 22A:
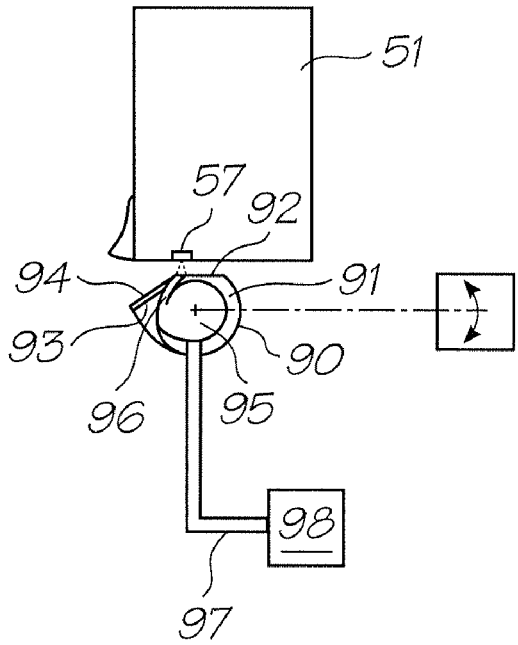

The mechanism that is illustrated in FIGS. 22A and B comprises a rotatable turret 90 that is positioned vertically below a single printhead 51, although it will be understood that two turrets might be employed in association with two arcuately moveable printheads if a duplex printhead assembly were to be employed. The turret 90 has an axially extending body portion 91, a longitudinally extending flat land portion 92 and a longitudinally extending eccentric land portion 93.

The eccentric land portion 93 of the turret carries a longitudinally extending capping member 94 that extends for substantially the full length of the printhead 51. Also, a purging chamber 95 is located within the turret 90 and opens to the flat land portion 92 by way of a port 96.

The flat land portion 92 of the turret effectively forms a platen and, when the turret is in the position shown in FIG. 22A, the land 92 constitutes the lower margin of a passageway through which print media is fed during a printing operation. Thus, when positioned adjacent (ie, just below) the printhead 51, the platen as defined by the land 92 provides support for normal print media feed through the printer.

Figure 22B:
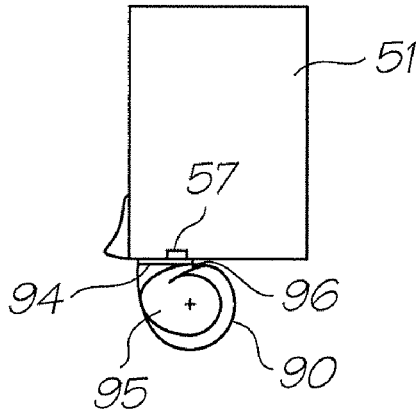

When capping is required, for example between successive print runs, the turret 90 is rotated to the position shown in FIG. 22B and, due to the eccentric positioning of the capping member 94 on the turret 90, the capping member is moved from a non-capping first position (FIG. 22A) to a second position (FIG. 22B) at which the capping member 94 is located in nozzle capping engagement with the printhead chips 57 on the printhead 51.

An actuating mechanism 97 is provided for effecting required rotation of the turret 90. That mechanism may comprise a geared motor drive, a pneumatic actuator or such other mechanism as is known in the art for effecting movement of relatively small mechanical devices.

When purging of the nozzles is to be effected, the turret is rotated to the position shown in FIG. 22A, such that the port 96 is located below the nozzles, and purged material is directed into the purging chamber 95 by way of the port 96. Purged material be sucked out of the purging chamber 95 by way of an extractor tube 97 that is connected to a suction device 98, such as a pump, in the printer.

Figure 23:
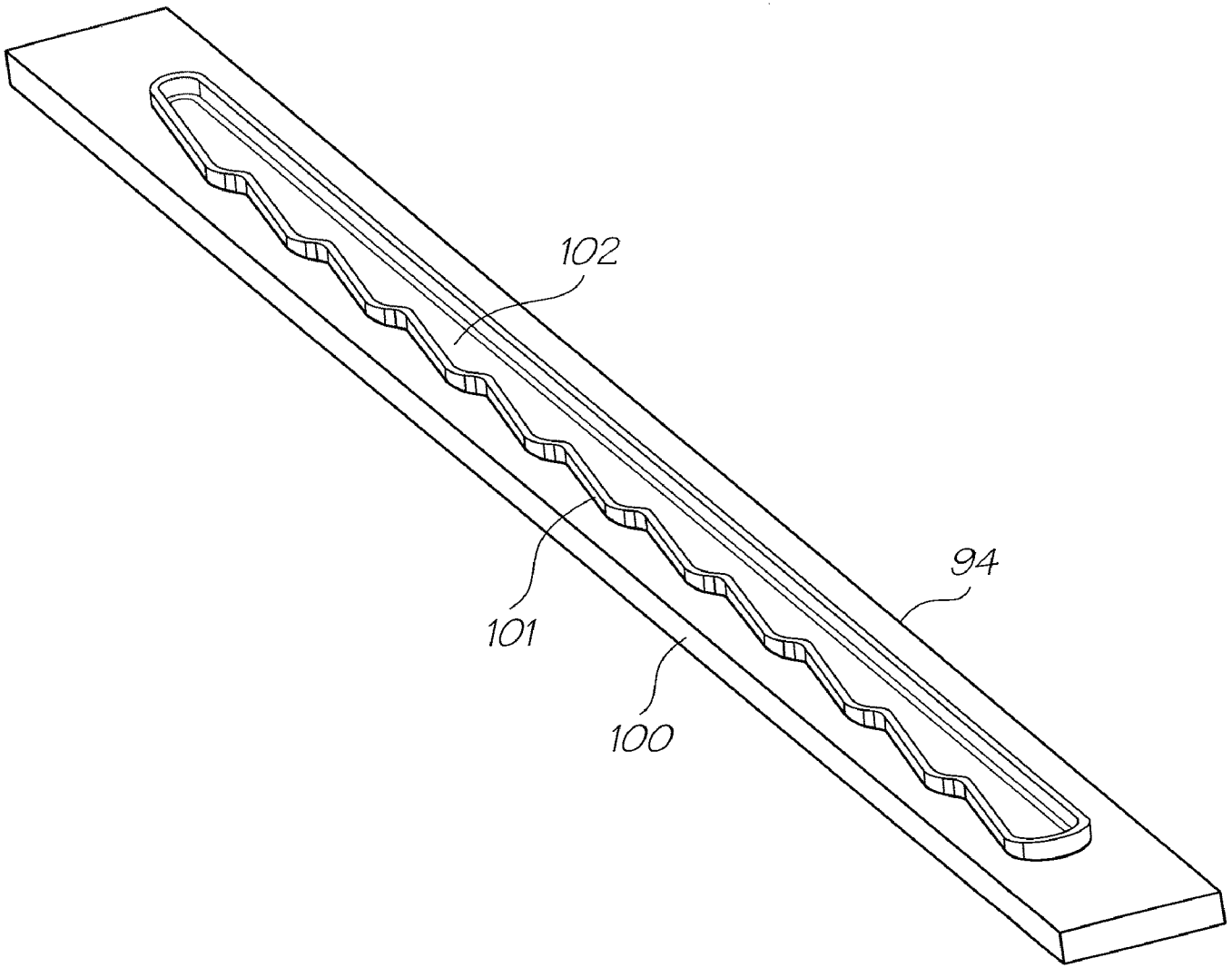
FIG. 23 shows a perspective view of a capping member of a type suitable for use in the mechanism shown in FIGS. 22A and B, FIGS. 24A, B and C show in block diagrammatic form a capping/purging mechanism that is applicable to a printhead assembly having a single printhead.

The capping member 94 as mounted to the turret 90 may have the configuration as illustrated in FIG. 23. The illustrated member comprise a body portion 100 and, moulded onto or otherwise secured to the body portion, a capping portion having an integrally formed lip portion 101 which surrounds a cavity 102. The body portion 100 is formed from a metal such as aluminum or from a rigid plastics material, and the capping portion (including the lip portion 101) is formed from an elastomeric material.

The lip portion 101 is peripherally configured to surround the printhead chips 57 collectively and the adjacent region of the printing zone of each or the printheads 51. Also, the cavity 102 may be provided or be lined with a hydrophobic material or a hydrophilic material, depending upon the function of the capping member and whether fluid that is purged from the printhead is to be expelled from or retained in the capping member.

The capping member 94 may be formed as a one-piece member with a length that corresponds with that of the printhead 51 to be capped or it may be formed from conjoined shorter-length portions that have an aggregate length corresponding to that of the printhead.

Figure 24A:
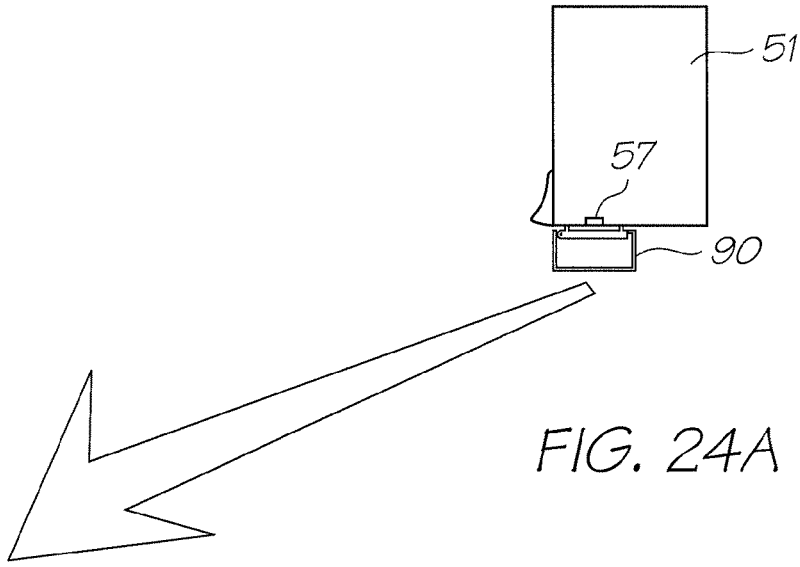

FIGS. 24A, B and C diagrammatically illustrate a capping/purging mechanism applicable to a printer having a single printhead 51. However, it will be understood that the mechanism might be adapted to a duplex printer, for example by separating or pivoting the printheads when capping and/or purging is required.

Figure 24B:
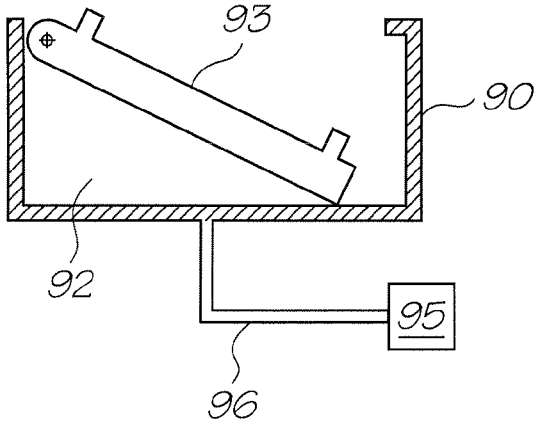
Figure 24C:
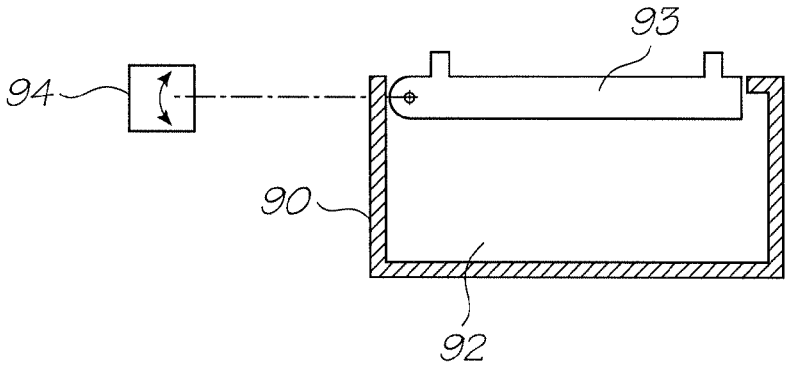

The mechanism that is illustrated in FIGS. 24A to C comprises a carrier 90 which is positioned vertically below and in confronting relationship to the printhead 51. The carrier incorporates a chamber 92 and it has a longitudinal length corresponding substantially to that of the printhead.

A longitudinally extending capping member 93 is pivotally mounted to the carrier 90 and it too has a longitudinal length corresponding substantially to that of the printhead 51.

An actuating mechanism 94 is provided and arranged to effect pivoting of the capping member 93 from a non-capping first position as indicated in FIG. 24B to a second position, as indicated in FIGS. 24A and 24C, at which the capping member is located in nozzle capping engagement with the printhead chips 57.

The actuating mechanism 94 may comprise a geared motor drive, a pneumatic actuator or such other mechanism as is known in the art for effecting movement of relatively small mechanical devices.

When capping is required, for example between successive print runs, the capping member 93 may simply be pivoted from the first to the second position, as described above, without effecting any movement of the carrier 90. In this case the carrier would be located a small distance below the printhead 51 and, in effect, define the lower margin of a passage through which print media is transported during a normal printing operation. In an alternative arrangement (not shown), the carrier 90 might be positioned well below the printhead 51 when the capping member 93 is in the first position and a further actuating mechanism would then be provided for elevating the carrier to the required capping position.

When purging of the nozzles is to be effected, the capping member 93 is pivoted to the position shown in FIG. 24B and purged material is directed into the purging chamber 92. The purged material will be sucked out of the purging chamber 92 by way of an extractor tube 96 that is connected to a suction device 95, such as a pump, in the printer. In an alternative arrangement (not shown) purged material may be directed through apertures in the capping member when the capping member 93 is located in the second position shown in FIGS. 24A and C.

Figure 25:
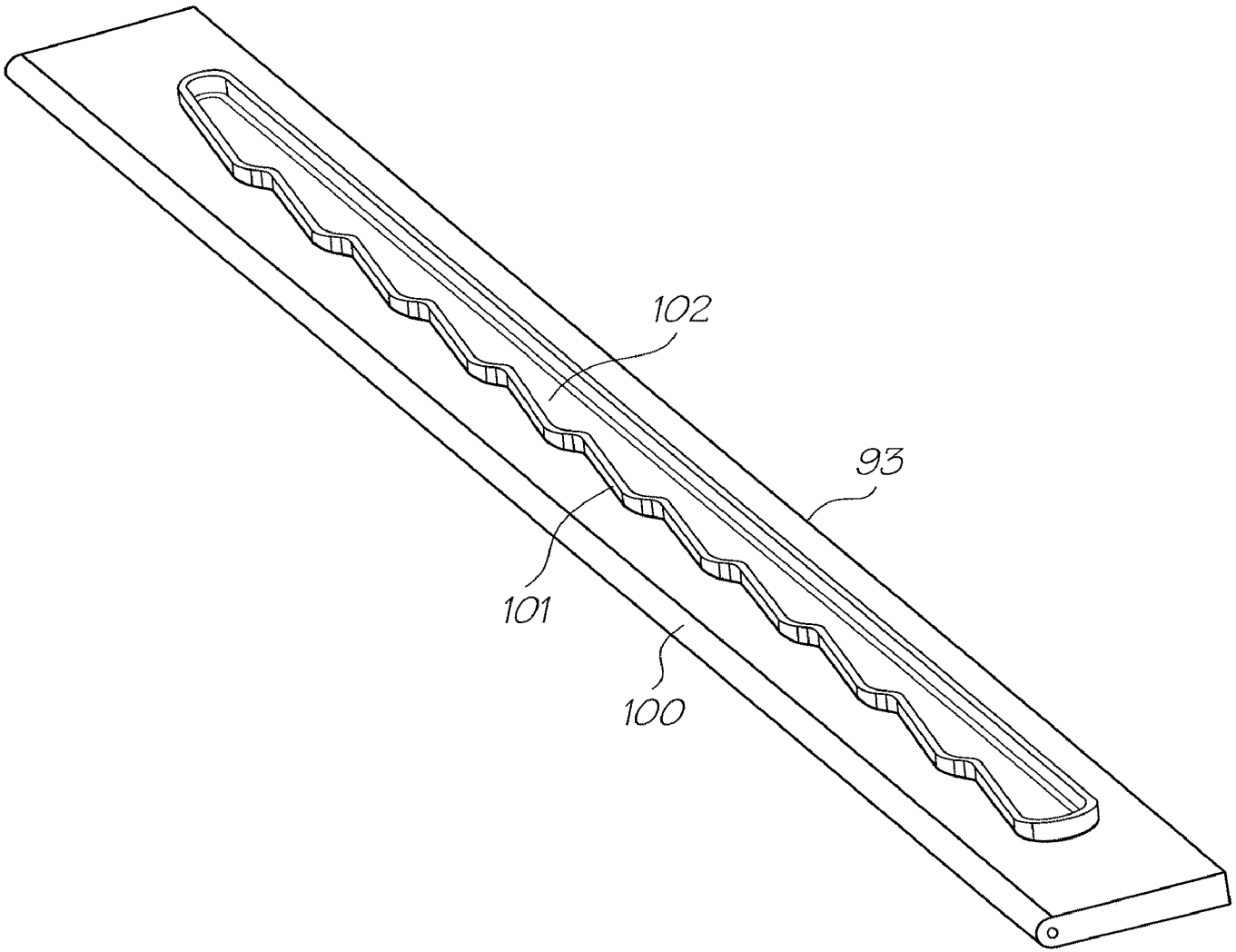
FIG. 25 shows a perspective view of a capping member of a type suitable for use in the mechanism shown in FIGS. 24A and B, FIGS. 26A and B show in block diagrammatic form an embodiment of the capping mechanism, being one that is applicable to a printhead assembly having two printheads, FIGS. 27A and B show in block diagrammatic form an embodiment of the capping mechanism, being one that is applicable to a printhead assembly having two printheads, FIGS. 28A and B show in block diagrammatic form an embodiment of the capping mechanism, being one that is applicable to a printhead assembly having two printheads, FIGS. 29A, B and C show in block diagrammatic form a capping mechanism that is applicable to a printhead assembly having two printheads.

The capping member 93 as pivotally mounted to the carrier 90 may have the configuration illustrated in FIG. 25. The illustrated member comprises a body portion 100 and, moulded onto or otherwise secured to the body portion, a capping portion having an integrally formed lip portion 101 that surrounds a cavity 102. The body portion 100 is formed from a metal such as aluminum or from a rigid plastics material, and the capping portion (including the lip portion 101) is formed from an elastomeric material.

The lip portion 101 is peripherally configured to surround the printhead chips 57 collectively and the adjacent region of the printing zone of each or the printheads 51. Also, the cavity 102 may be provided or be lined with a hydrophobic material or a hydrophilic material, depending upon the function of the capping member and whether fluid that is purged from the printhead is to be expelled from or retained in the capping member.

Figure 26A:
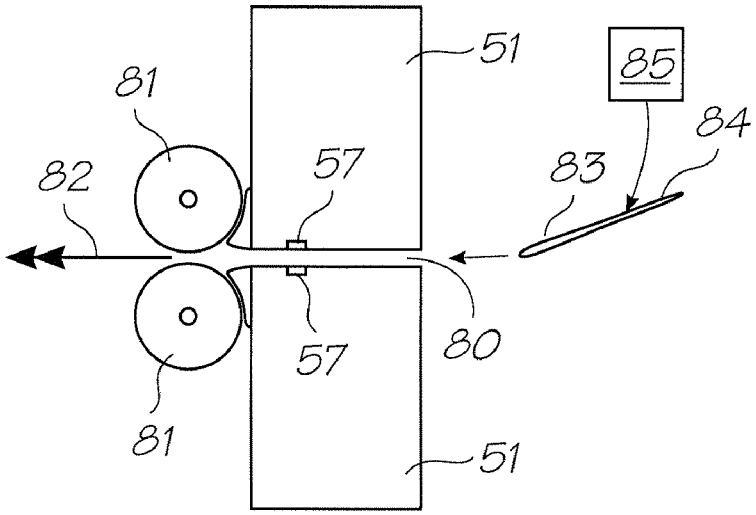

FIGS. 26A and B diagrammatically illustrate duplex printheads 51 but it will be understood that one of the printheads might be replaced with a platen that would define a lower margin of a passage for print media and act as a support for the capping member that is to be described As illustrated in FIGS. 26A and B, the two printing heads 51 are positioned in confronting relationship and are separated by a gap 80 through which print media (not shown) is fed during a printing operation. When capping is required, for example between successive print runs, any print media that is present between the printheads 51 will be retracted by rollers 81 in the direction of arrow 82, and a capping member 83 will be directed into the gap 80 and be positioned in nozzle capping engagement with all of the printhead chips 57 that are mounted to both of the printheads.

The capping member 83 is directed into the gap 80 by way of a ramp or chute 84 and an actuating mechanism 85 is employed for propelling the capping member into the desired position. The actuating mechanism may comprise a geared motor drive, pneumatic actuator or other such mechanism as is known in the art for effecting movement of relatively small mechanical devices.

The capping member is dimensioned to cover the confronting surfaces of the printheads 51 and, thus, it has a depth (in the direction of arrow 82) approximately equal to that of the printhead 51 and a width (in the direction into the page) which is approximately equal to the length of the printheads.

The capping member 83 may be formed from various types of materials that have a sheet-like form and are flexible. The sheet-like form is required in order that the capping member might be inserted into the relatively narrow gap 80 that will normally be present between the printheads 51, and flexibility is required to enable the creation of an effective capping seal between the capping member and the printheads.

The material from which the capping member 83 is formed will be dependent upon whether simple capping is required or whether the capping member is required also to absorb and carry purged ink and other material away from the printing zone of the printheads. For simple capping the material might be selected for hydrophobic properties, and when required to assist in purging functions the material might be selected for hydrophilic properties. The former material might comprise a closed cell thermoplastics material and the latter material might comprise and open cell silicone material.

Figure 26B:
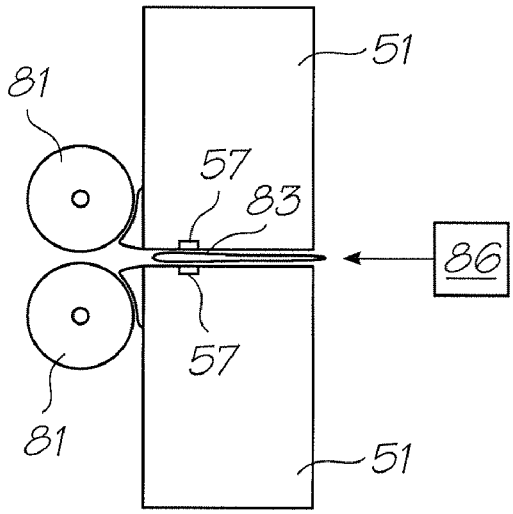

In any event, the material from which the capping member is formed will normally exhibit a degree of compressibility in order that a positive reactive force might be established and maintained between the printheads and the capping member during the capping operation. Alternatively or additionally, the capping member 83 might be formed from layered sheets, so that a fluid (ie, a liquid or a gas) might be directed into the region between the layers to change the effective thickness of the capping member. A fluid delivery mechanism 86 is shown in FIG. 26B for this purpose.

Figure 27A:
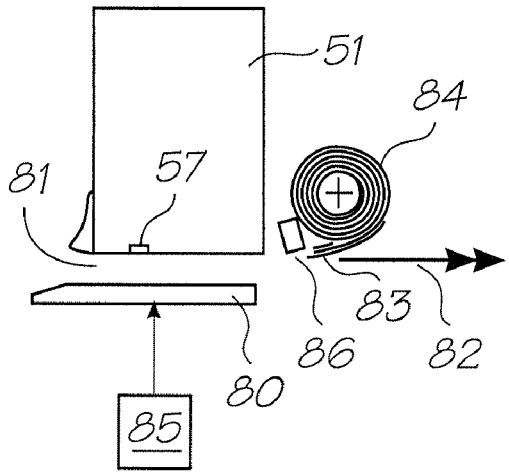
Figure 27B:
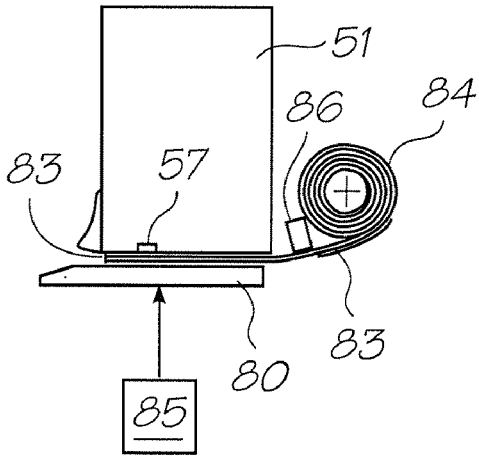

FIGS. 27A and B diagrammatically illustrate a simplex printhead arrangement but it will be understood that the invention also applies to a duplex arrangement, in which case the illustrated platen would be replaced with a lower printhead.

The mechanism that is illustrated in FIGS. 27A and B is suitable for use in conjunction with a wide format printer having a single printhead 51. A platen 86 and the single printhead 51 define a gap 81 through which the print media is fed, in the direction of arrow 82.

A capping member 83 is provided in the form of a replaceable roll 84 of sheet material of a type to be described (by way of example) and, when a capping operation is to be performed, for example between print runs, the following operations are performed:

1. Print media is advanced beyond the printhead assembly in the direction of arrow 82.
2. The platen 80 is lowered by an actuating mechanism 85.
3. The sheet-like capping member 83 is fed through the gap 81 from the roll 84.
4. The platen 80 is raised by the actuating mechanism 85 to position the capping member 83 in nozzle capping engagement with the printhead chips 57.

When capping is no longer required and a purging operation, if any, has been completed, the spent capping member 83 is separated from the roll 84 by a cutter mechanism 86 and the capping member is drawn from the gap 81 in the direction opposite to that indicated by arrow 82.

Feeding of the capping member 83 into and out from the gap 81 may be effected manually or mechanically, depending upon the size and required operating speed of the printer of which the capping mechanism forms a part.

When the capping mechanism as illustrated is employed in a wide format printer, the cutter mechanism 86 may comprise one that typically is used to effect the cutting of print media that is fed through the printer from a roll of the print media.

The actuating mechanism 85 may comprise a geared motor drive, pneumatic actuator or other such mechanism as is known in the art for effecting movement of relatively small mechanical devices.

The capping member is dimensioned to cover the confronting surfaces of the printheads 51 and, thus, it has a width (in the direction into the page) which is approximately equal to the length of the printheads.

The capping member 83 may be formed from various types of materials that have a sheet-like form and are flexible. The sheet-like form is required in order that the capping member might be inserted into the relatively narrow gap 81 that will normally be present between the printhead 51 and the platen 80 (or between two printheads in the case of a duplex assembly), and flexibility is required to enable the creation of an effective capping seal between the capping member and the printhead(s).

The material from which the capping member 83 is formed will be dependent upon whether simple capping is required or whether the capping member is required also to absorb and carry purged ink and other material away from the printing zone of the printhead. For simple capping the material might be selected for hydrophobic properties, and when required to assist in purging functions the material might be selected for hydrophilic properties. The former material might comprise a closed cell thermoplastics material and the latter material might comprise and open cell silicone material.

In any event, the material from which the capping member is formed will normally exhibit a degree of compressibility in order that a positive reactive force might be established and maintained between the printheads and the capping member during the capping operation. Alternatively or additionally, the capping member 83 might be formed from layered sheets, so that a fluid (ie, a liquid or a gas) might be directed into the region between the layers to change the effective thickness of the capping member.

Figure 28A:
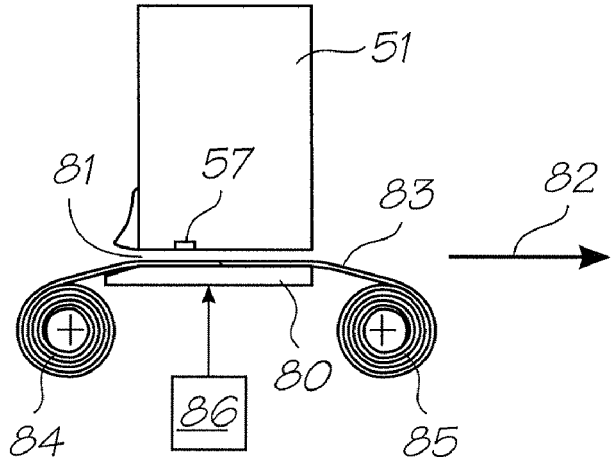
Figure 28B:
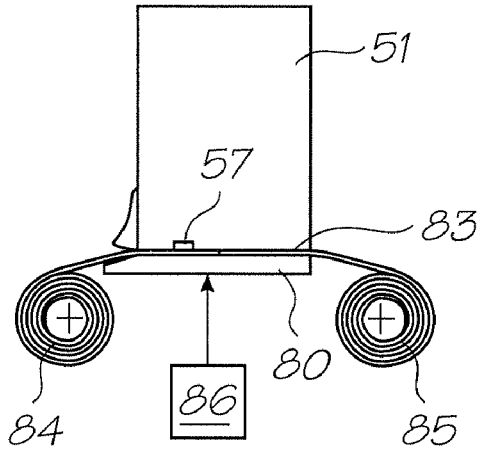

FIGS. 28A and B diagrammatically illustrate a simplex printhead arrangement but it will be understood that the invention also applies to a duplex arrangement, in which case the illustrated platen would be replaced with a lower printhead.

The mechanism that is illustrated in FIGS. 28A and B is suitable for use in conjunction with a wide format printer having a single printhead 51. A platen 80 and the single printhead 51 define a gap 81 through which the print media is fed, in the direction of arrow 82.

A capping member 83 is provided in the form of a portion of a replaceable roll 84 of sheet material of a type to be described (by way of example), and a take-up reel 85 is provided for storing spent sheet material 83 following a capping and/or purging operation.

When a capping operation is to be performed, for example between print runs, the following operations are performed:

1. Print media is advanced beyond the printhead assembly in the direction of arrow 82 or, if required, is retracted in the opposite direction.
2. The platen 80 is lowered by an actuating mechanism 86.
3. The sheet-like capping member 83 is fed through the gap 81 from the roll 84 to the take-up reel 85.
4. The platen 80 is raised by the actuating mechanism 86 to position the capping member 83 in nozzle capping engagement with the printhead chips 57.

When capping is no longer required and a purging operation, if any, has been completed, the spent capping member portion of the capping material 83 is moved through the gap 81 and wound onto the take-up reel 85.

Feeding of the capping member 83 into and out from the gap 81 may be effected manually or mechanically, depending upon the size and required operating speed of the printer of which the capping mechanism forms a part.

The actuating mechanism 85 may comprise a geared motor drive, pneumatic actuator or other such mechanism as is known in the art for effecting movement of relatively small mechanical devices.

The roll 84 of sheet-like capping material has a width (in the direction into the page) which is approximately equal to the length of the printheads.

The capping member 83 may be formed from various types of materials that have a sheet-like form and are flexible. The sheet-like form is required in order that the capping member might be inserted into the relatively narrow gap 81 that will normally be present between the printhead 51 and the platen 80 (or between two printheads in the case of a duplex assembly), and flexibility is required to enable the creation of an effective capping seal between the capping member and the printhead(s).

The material from which the capping member 83 is formed will be dependent upon whether simple capping is required or whether the capping member is required also to absorb and carry purged ink and other material away from the printing zone of the printhead.

For simple capping the material might be selected for hydrophobic properties, and when required to assist in purging functions the material might be selected for hydrophilic properties. The former material might comprise a closed cell thermoplastics material and the latter material might comprise and open cell silicone material.

In any event, the material from which the capping member is formed will normally exhibit a degree of compressibility in order that a positive reactive force might be established and maintained between the printheads and the capping member during the capping operation. Alternatively or additionally, the capping member 83 might be formed from layered sheets, so that a fluid (ie, a liquid or a gas) might be directed into the region between the layers to change the effective thickness of the capping member.

Figure 29A:
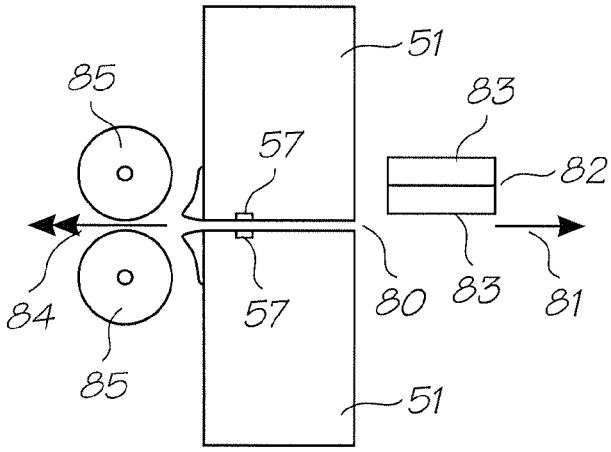
Figure 29B:
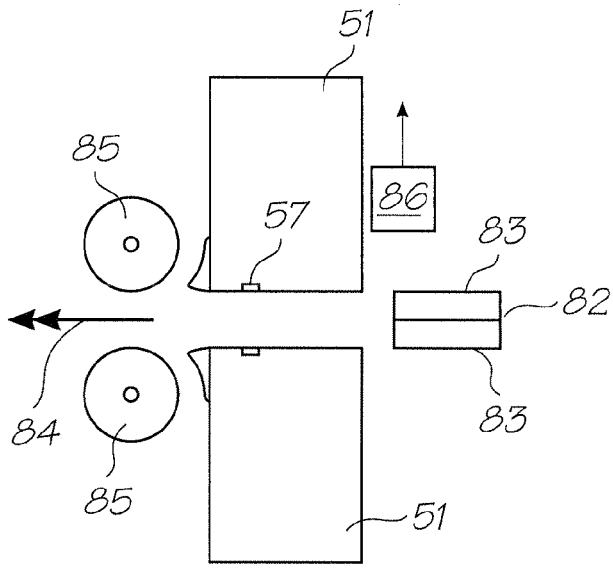
Figure 29C:
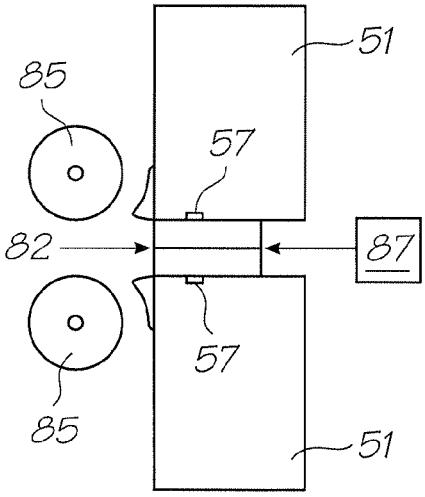

In the mechanism shown in FIGS. 29A-C, two (duplex) printheads 51 are positioned one above the other to define a gap 80 through which print media is passed, in the direction of arrow 81, during a printing operation. A single capping member 82 having opposed capping faces 83 is positioned adjacent the printing heads and slightly above the path of the print media.

When capping is required, any print media that is positioned in the printer is moved in the direction of arrow 84 by rollers 85 and the upper printhead 51 is raised (relative to the lower printhead) by an actuating mechanism 86, as indicated in FIG. 29B. The capping member 82 is then moved rectilinearly by an actuating mechanism 87 to the position shown in FIG. 29C, where it is interposed between the printheads 51 and located in nozzle capping engagement with the printhead chips 57 on both of the printheads. Positive engagement between the capping member 82 and the two printheads is effected by lowering the upper printhead 51 onto the capping member 82.

The actuating mechanisms 86 and 87, as shown in block diagrammatic form in FIGS. 29B and 29C and as employed for effecting the described movements of the printheads 51, may comprise geared motor drives, pneumatic actuators or other such mechanisms as are known in the art for effecting movement of relatively small mechanical devices.

Figure 30:
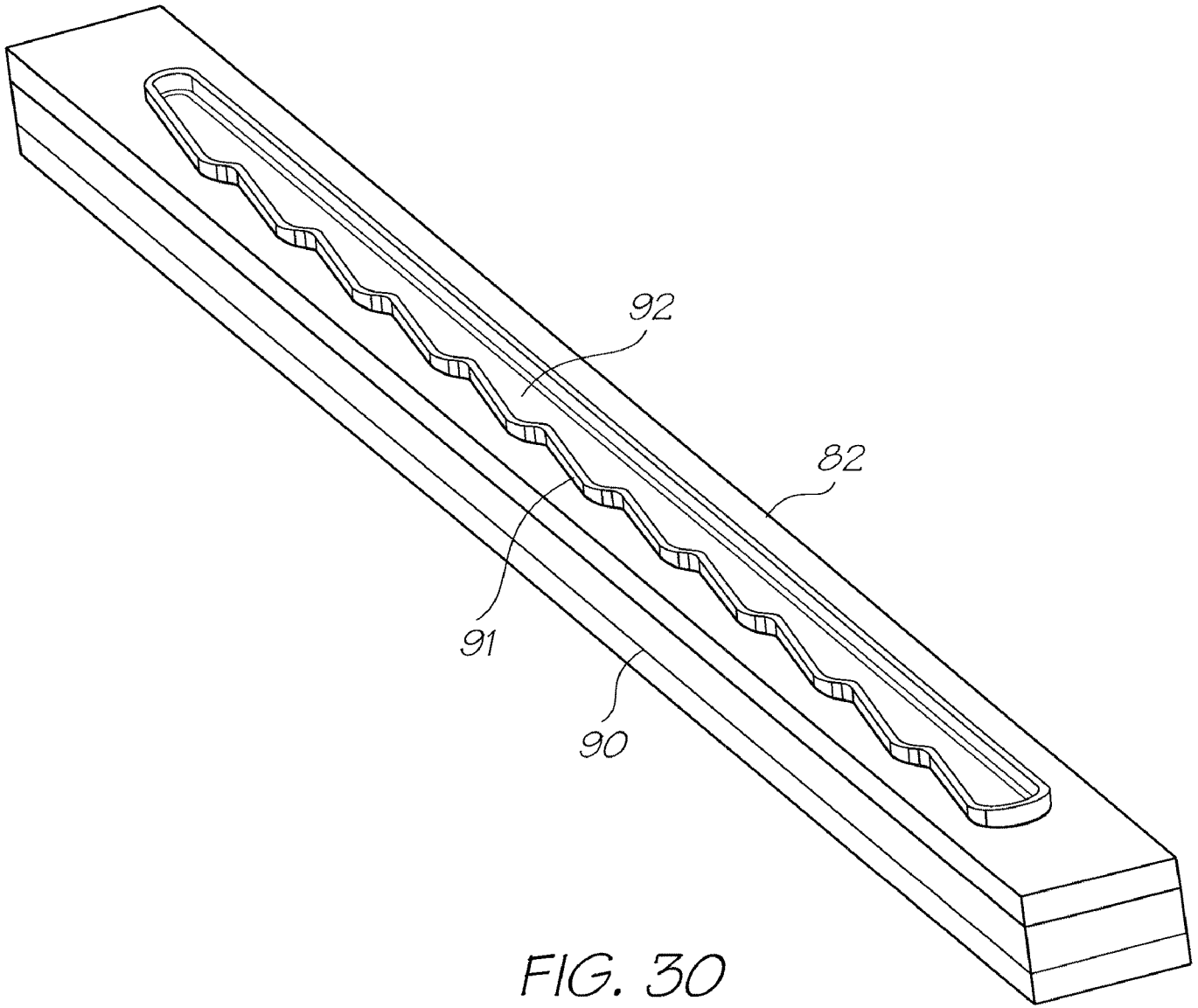
FIG. 30 shows a perspective view of a capping member of a type suitable for use in the mechanisms shown in FIGS. 29A, B and C.

The capping member 82 may, as illustrated in FIG. 30, comprise a single-sided member when required to cap a single printhead 51 or it may, for the capping function illustrated in FIGS. 7A to C, be double sided. In either case, the capping side or portion of the member has a configuration as shown in FIG. 30.

As illustrated, the capping member 82 has a body portion 90 onto which is moulded or otherwise secured a capping portion having an integrally formed lip portion 91 which surrounds a cavity 92. The body portion 90 is formed from a metal such as aluminum or from a rigid plastics material, and the capping portion (including the lip portion 91) is formed from an elastomeric material.

The lip portion 91 is peripherally configured to surround the printhead chips 57 collectively and the adjacent region of the printing zone of each or the printheads 51. Also, the cavity 92 may be provided or be lined with a hydrophobic material or a hydrophilic material, depending upon the function of the capping member and whether fluid that is purged from the printhead is to be expelled from or retained in the capping member.

The capping member 82 may be formed as a one-piece member with a length that corresponds with that of the printhead to be capped or it may be formed from conjoined shorter-length portions that have an aggregate length corresponding to that of the printhead.

The interior or underside of the capping member as illustrated in FIG. 30 may be formed with a cavity or chamber (a "purging chamber") for receiving material that is purged from a printhead during a purging operation. Purged material may be directed into the purging chamber either by way of the cavity 92 or by way of a separate route.

One of the printhead chips 57 is now described in more detail with reference to FIGS. 31 to 40.

As indicated above, each printhead chip 57 is provided with 7680 printing fluid delivery nozzles 150. The nozzles are arrayed in twelve rows 151, each having 640 nozzles, with an inter-nozzle spacing X of 32 microns. Adjacent rows are staggered by a distance equal to one-half of the inter-nozzle spacing so that a nozzle in one row is positioned mid-way between two nozzles in adjacent rows. Also, there is an inter-nozzle spacing Y of 80 microns between adjacent rows of nozzles.

Two adjacent rows of the nozzles 150 are fed from a common supply of printing fluid. This, with the staggered arrangement, allows for closer spacing of ink dots during printing than would be possible with a single row of nozzles and also allows for a level of redundancy that accommodates nozzle failure.

The printhead chips 57 are manufactured using an integrated circuit fabrication technique and, as previously indicated, embody micro-electromechanical systems (MEMS). Each printhead chip includes a silicon wafer substrate 152, and a 0.42 micron 1 P4M 12 volt CMOS micro-processing circuit is formed on the wafer. Thus, a silicon dioxide layer 153 is deposited on the substrate 152 as a dielectric layer and aluminum electrode contact layers 154 are deposited on the silicon dioxide layer 153. Both the substrate 152 and the layer 153 are etched to define an ink channel 155, and an aluminum diffusion barrier 156 is positioned about the ink channel 155.

A passivation layer 157 of silicon nitride is deposited over the aluminum contact layers 154 and the layer 153. Portions of the passivation layer 157 that are positioned over the contact layers 154 have openings 158 therein to provide access to the contact layers.

Each nozzle 150 includes a nozzle chamber 159 which is defined by a nozzle wall 160, a nozzle roof 161 and a radially inner nozzle rim 162. The ink channel 155 is in fluid communication with the chamber 159.

Figure 35:
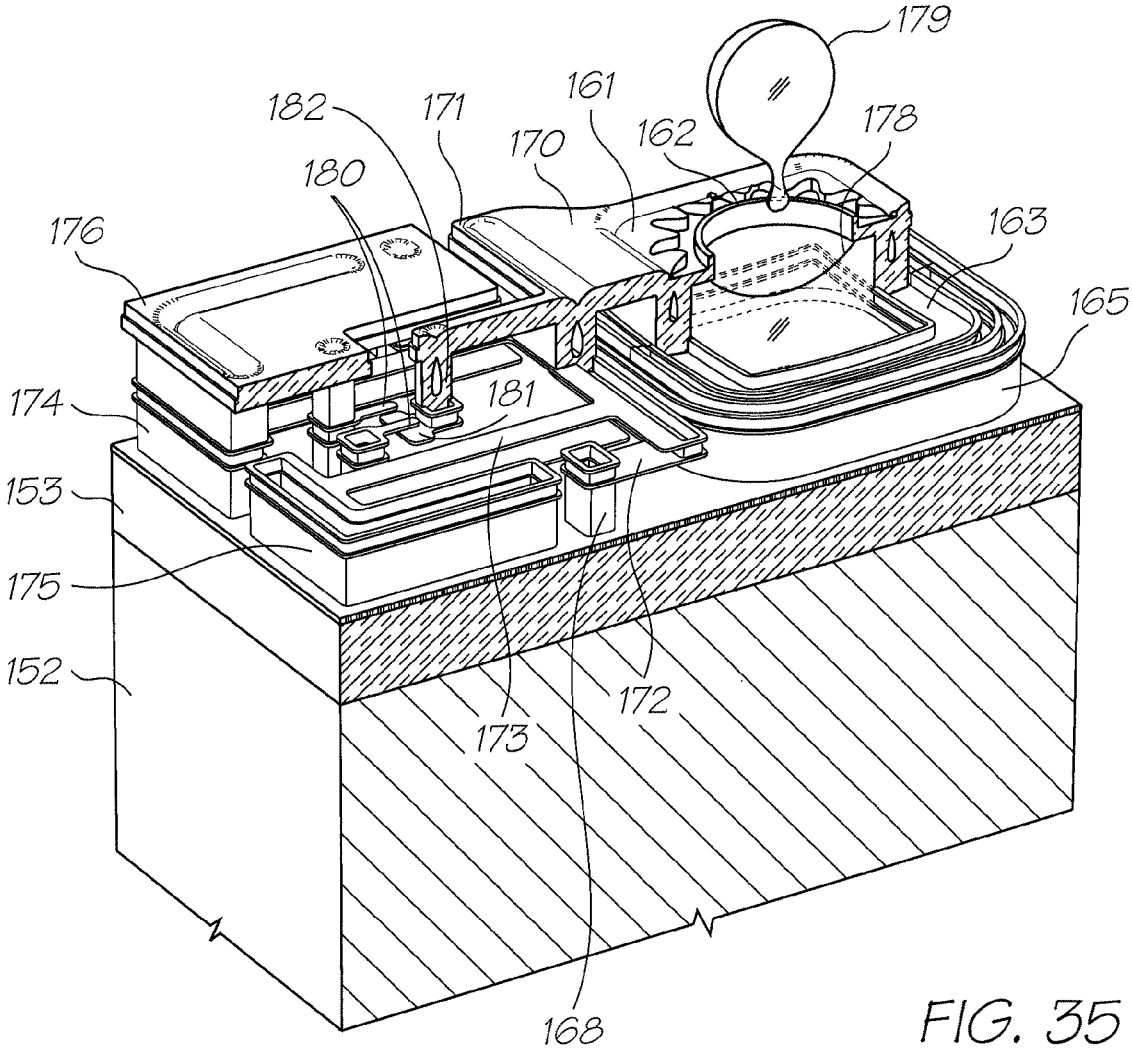
FIG. 35 shows a perspective view of a single nozzle in the activation state shown in FIG. 34.
Figure 36:
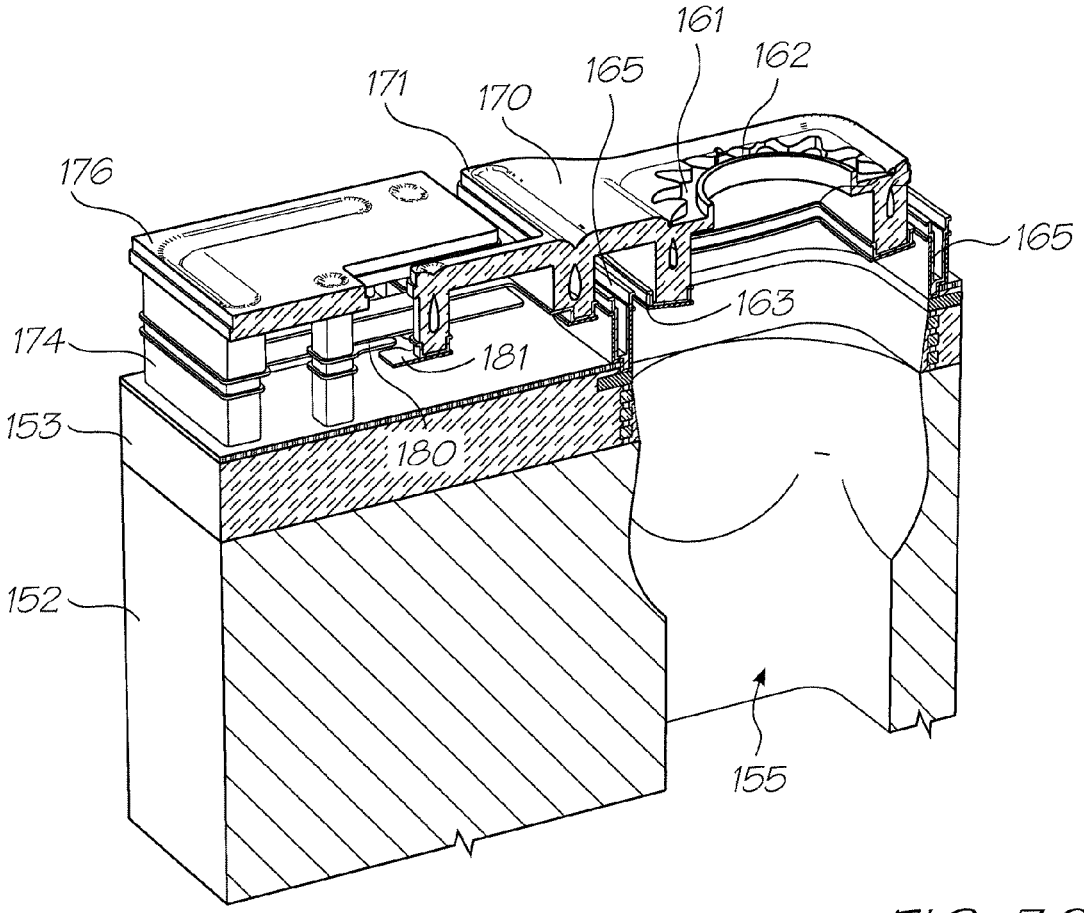
FIG. 36 shows in perspective a sectioned view of the nozzle of FIG. 13.
Figure 37:
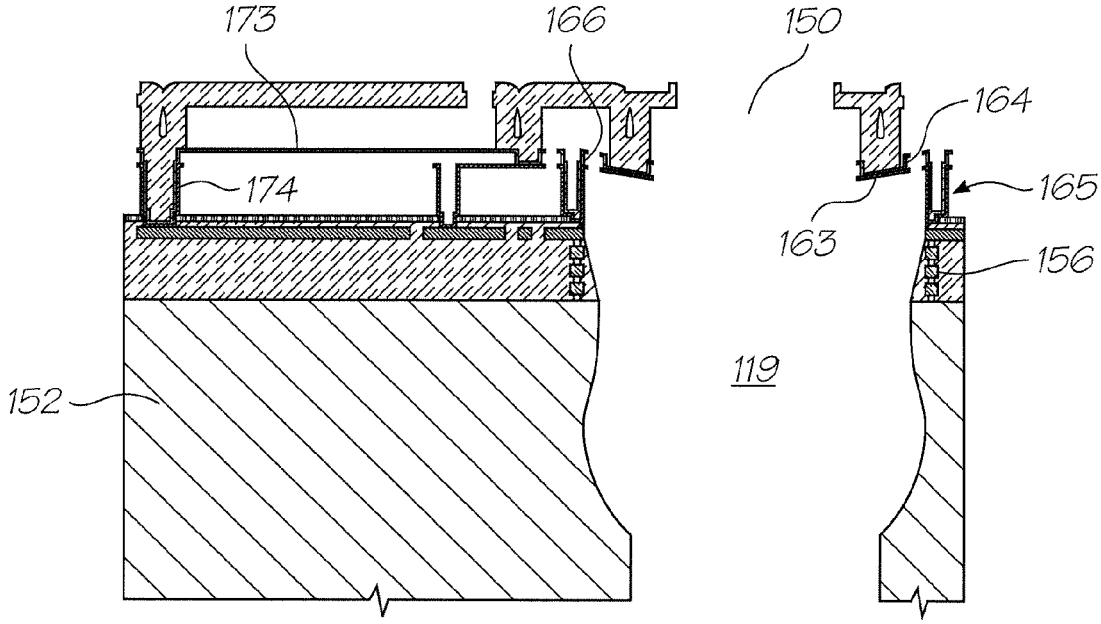
FIG. 37 shows a sectional elevation view of the nozzle of FIG. 13.

A moveable rim 163, that includes a movable seal lip 164, is located at the lower end of the nozzle wall 160. An encircling wall 165 surrounds the nozzle and provides a stationery seal lip 166 that, when the nozzle 150 is at rest as shown in FIG. 35, is adjacent the moveable rim 163. A fluidic seal 167 is formed due to the surface tension of ink trapped between the stationery seal 166 and the moveable seal lip 164. This prevents leakage of ink from the chamber whilst providing a low resistance coupling between the encircling wall 165 and a nozzle wall 160.

The nozzle wall 160 forms part of lever arrangement that is mounted to a carrier 168 having a generally U-shaped profile with a base 169 attached to the layer 157. The lever arrangement also includes a lever arm 170 that extends from the nozzle wall and incorporates a lateral stiffening beam 171.

Figure 31:
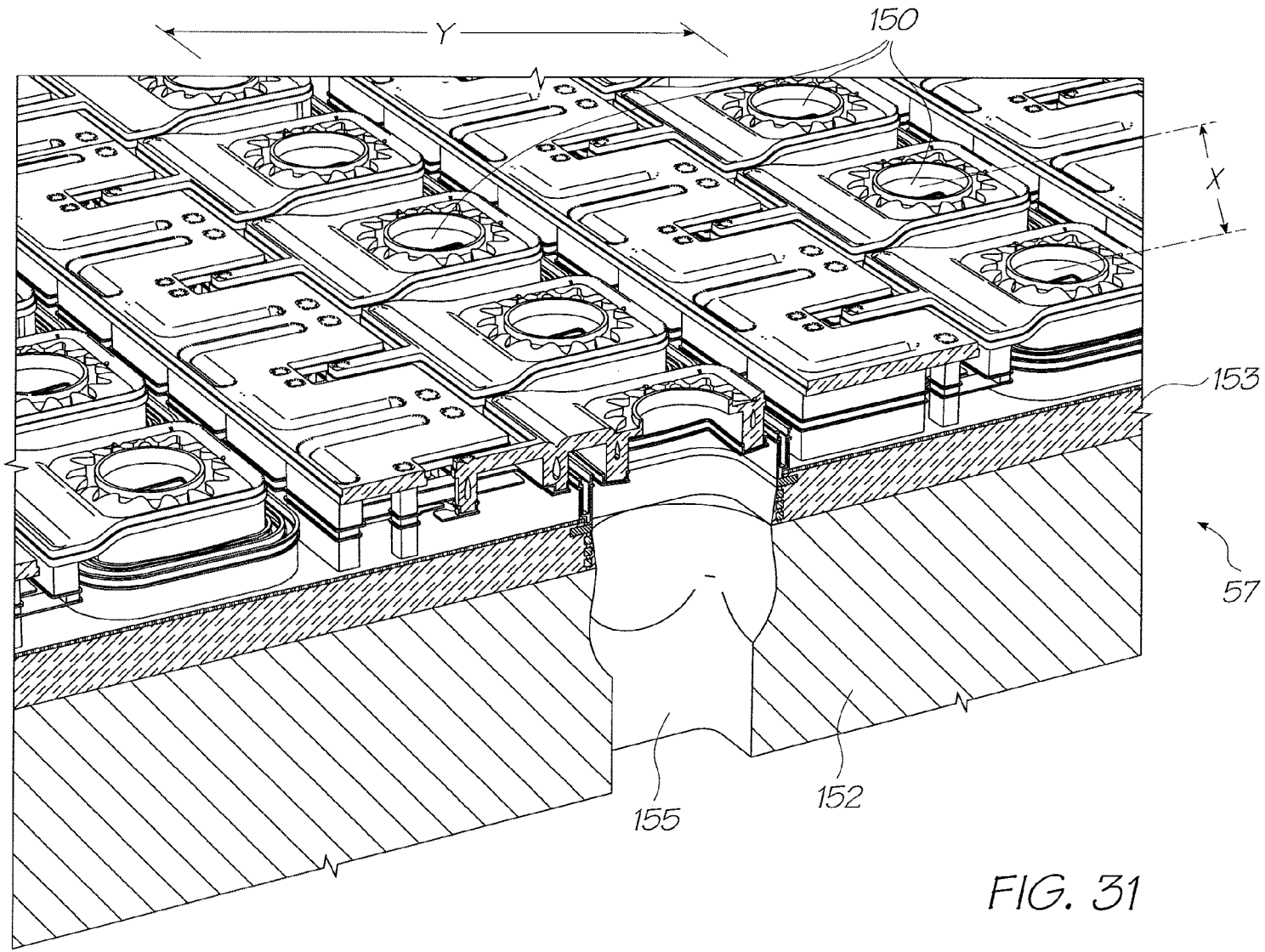
FIG. 31 shows, in perspective, a sectional view of a portion a printhead chip that is mounted to the printhead and which incorporates printing fluid delivery nozzles and nozzle actuators.
Figure 32:
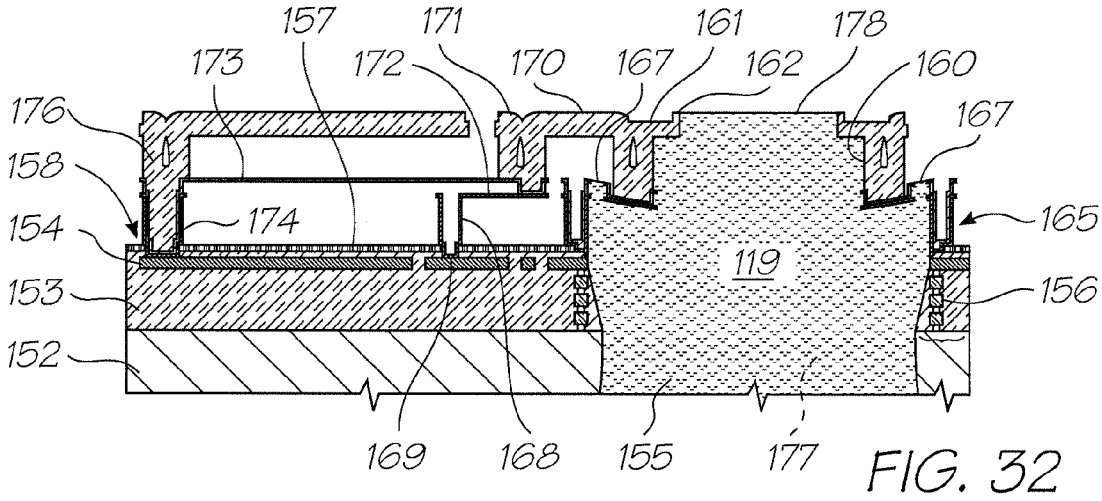
FIG. 32 shows a vertical section of a single nozzle in a quiescent state.
Figure 38:
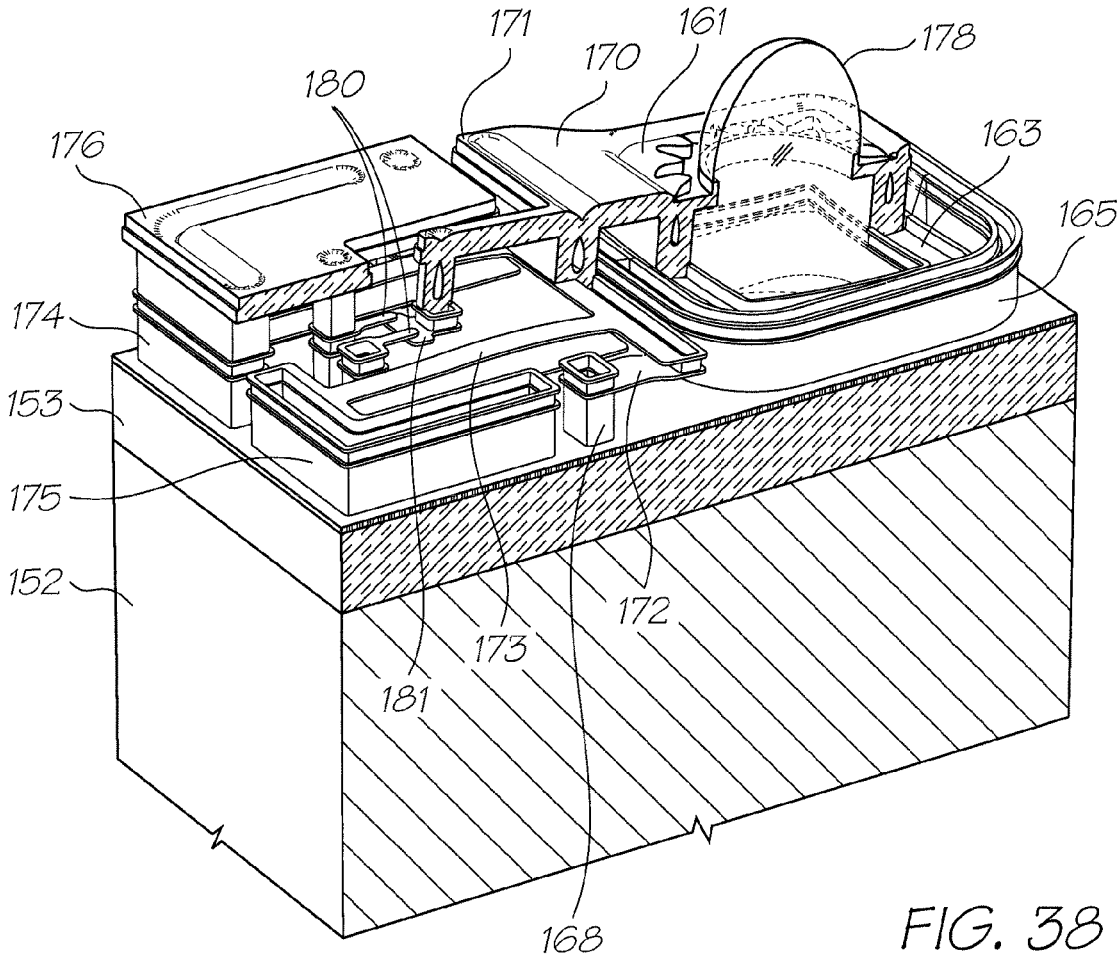
FIG. 38 shows in perspective a partial sectional view of the nozzle of FIG. 33.
Figure 39:
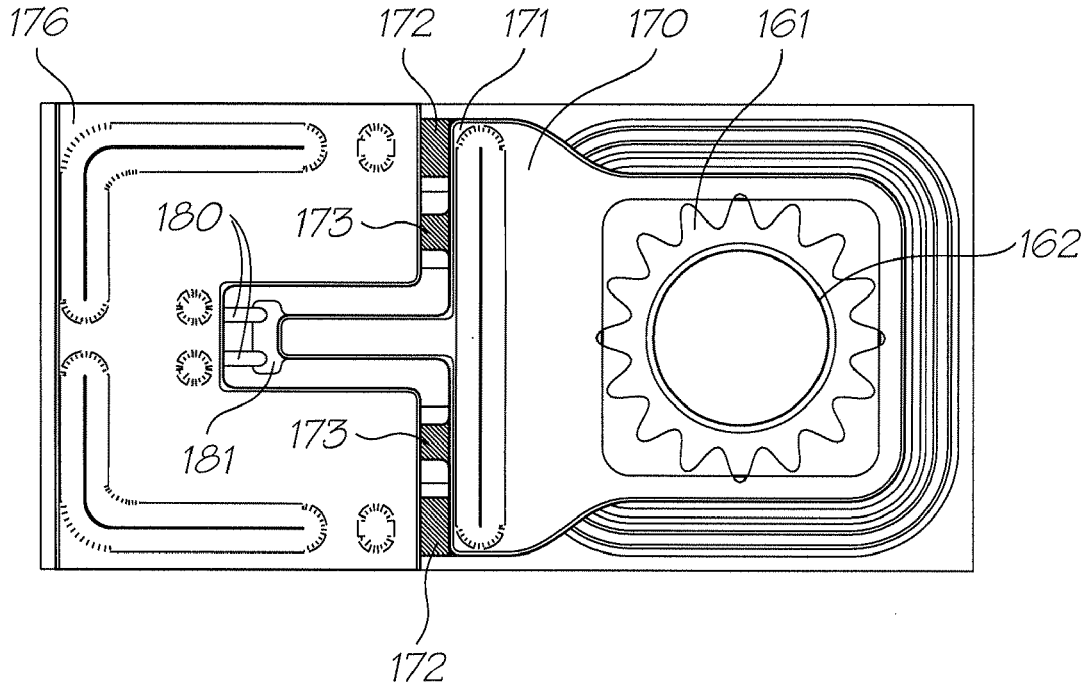
FIG. 39 shows a plan view of the nozzle of FIG. 32.

The lever arm 170 is attached to a pair of passive beams 172 that are formed from titanium nitride and are positioned at each side of the nozzle as best seen in FIGS. 31 and 38. The other ends of the passive beams 172 are attached to the carriers 168.

The lever arm 170 is also attached to an actuator beam 173, which is formed from TiN. This attachment to the actuator beam is made at a point a small but critical distance higher than the attachments to the passive beam 172.

As can best be seen from FIGS. 31 and 38, the actuator beam 173 is substantially U-shaped in plan, defining a current path between an electrode 174 and an opposite electrode 175. Each of the electrodes 174 and 175 is electrically connected to a respective point in the contact layer 154. The actuator beam 173 is also mechanically secured to an anchor 176, and the anchor 176 is configured to constrain motion of the actuator beam 173 to the left of FIGS. 32 to 34 when the nozzle arrangement is activated.

The actuator beam 173 is conductive, being composed of TiN, but has a sufficiently high electrical resistance to generate self-heating when a current is passed between the electrodes 174 and 175. No current flows through the passive beams 172, so they do not experience thermal expansion.

In operation, the nozzle is filled with ink 177 that defines a meniscus 178 under the influence of surface tension. The ink is retained in the chamber 159 by the meniscus, and will not generally leak out in the absence of some other physical influence.

To fire ink from the nozzle, a current is passed between the contacts 174 and 175, passing through the actuator beam 173. The self-heating of the beam 173 causes the beam to expand, and the actuator beam 173 is dimensioned and shaped so that the beam expands predominantly in a horizontal direction with respect to FIGS. 32 to 34. The expansion is constrained to the left by the anchor 176, so the end of the actuator beam 173 adjacent the lever arm 170 is impelled to the right.

The relative horizontal inflexibility of the passive beams 172 prevents them from allowing much horizontal movement of the lever arm 170. However, the relative displacement of the attachment points of the passive beams and actuator beam respectively to the lever arm causes a twisting movement that, in turn, causes the lever arm 170 to move generally downwardly with a pivoting or hinging motion. However, the absence of a true pivot point means that rotation is about a pivot region defined by bending of the passive beams 172.

Figure 33:
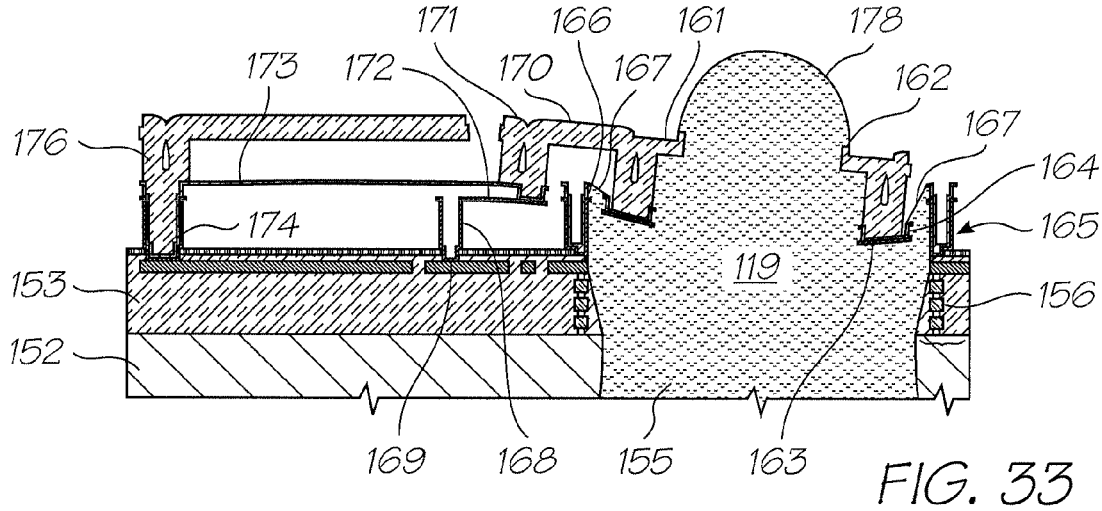
FIG. 33 shows a vertical section of a single nozzle in an initial activation state.

The downward movement (and slight rotation) of the lever arm 170 is amplified by the distance of the nozzle wall 160 from the passive beams 172. The downward movement of the nozzle walls and roof causes a pressure increase within the chamber 159, causing the meniscus 178 to bulge as shown in FIG. 33, although the surface tension of the ink causes the fluid seal 167 to be stretched by this motion without allowing ink to leak out.

Figure 40:
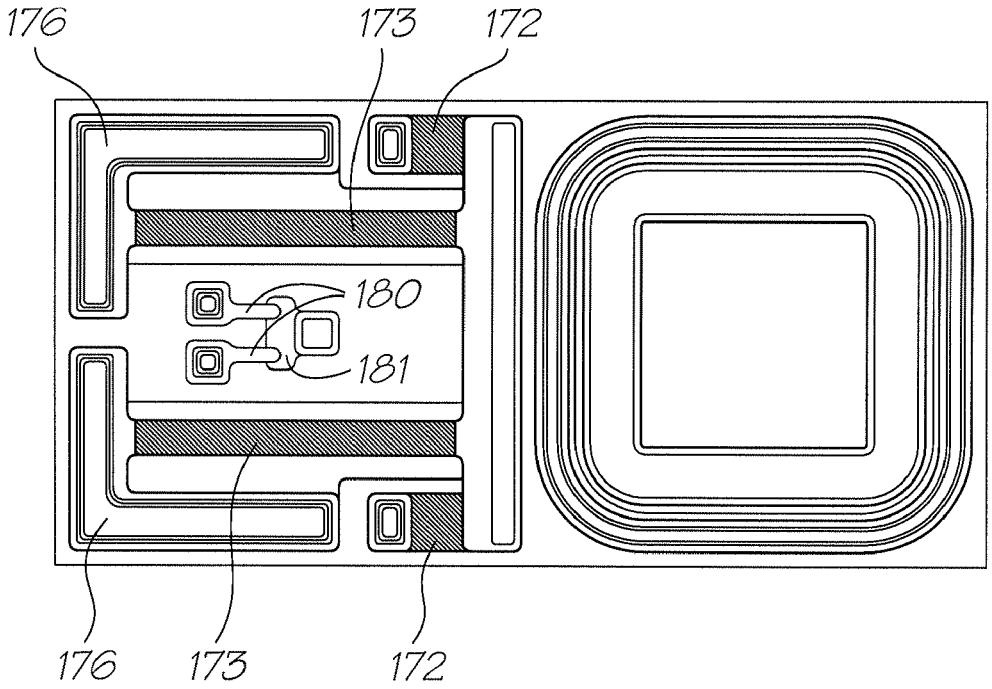
FIG. 40 shows a view similar to FIG. 39 but with lever arm and moveable nozzle portions omitted.

As shown in FIG. 40, at the appropriate time the drive current is stopped and the actuator beam 173 quickly cools and contracts. The contraction causes the lever arm to commence its return to the quiescent position, which in turn causes a reduction in pressure in the chamber 159. The interplay of the momentum of the bulging ink and its inherent surface tension, and the negative pressure caused by the upward movement of the nozzle chamber 159 causes thinning, and ultimately snapping, of the bulging meniscus 178 to define an ink drop 179 that continues outwardly until it contacts passing print media.

Figure 34:
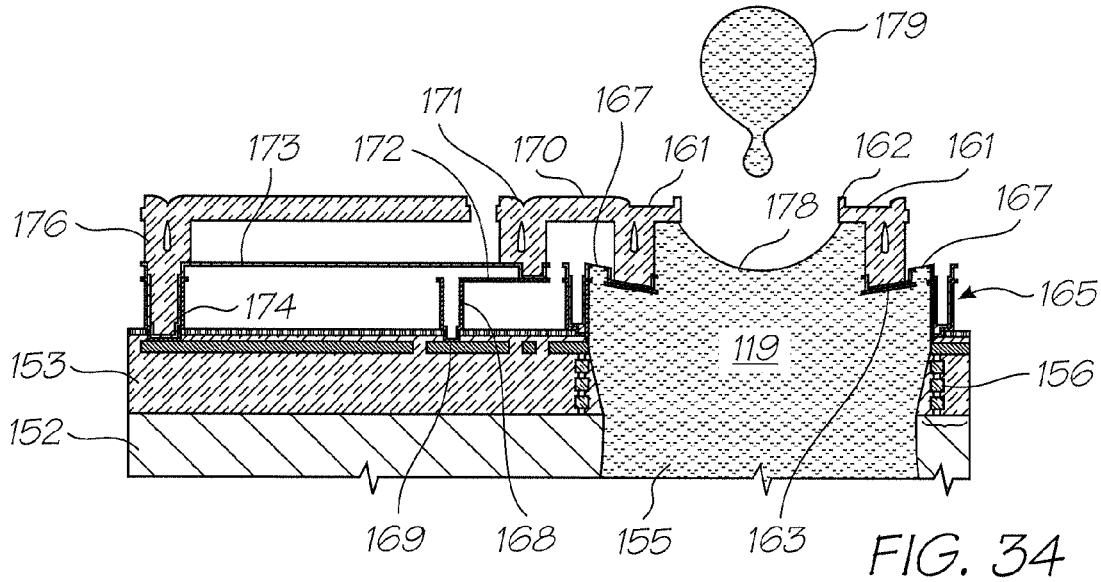
FIG. 34 shows a vertical section of a single nozzle in a later activation state.

Immediately after the drop 179 detaches, the meniscus 178 forms the concave shape shown in FIG. 34. Surface tension causes the pressure in the chamber 159 to remain relatively low until ink has been sucked upwards through the inlet 155, which returns the nozzle arrangement and the ink to the quiescent situation shown in FIG. 34.

As can best be seen from FIG. 35, the printhead chip 57 also incorporates a test mechanism that can be used both post-manufacture and periodically after the printhead assembly has been installed. The test mechanism includes a pair of contacts 180 that are connected to test circuitry (not shown). A bridging contact 181 is provided on a finger 182 that extends from the lever arm 170. Because the bridging contact 181 is on the opposite side of the passive beams 172, actuation of the nozzle causes the bridging contact 181 to move upwardly, into contact with the contacts 180. Test circuitry can be used to confirm that actuation causes this closing of the circuit formed by the contacts 180 and 181. If the circuit is closed appropriately, it can generally be assumed that the nozzle is operative.

As stated previously the integrated circuits of the printhead chips 57 are controlled by the print engine controller (PEC) integrated circuits of the drive electronics 63. One or more PEC integrated circuits 100 is or are provided (depending upon the printing speed required) in order to enable page-width printing over a variety of different sized pages or continuous sheets. As described previously, each of the printed circuit boards 62 carried by the support moulding 66 carries one PEC integrated circuit 190 (FIG. 41) which interfaces with four of the printhead chips 57, and the PEC integrated circuit 190 essentially drives the integrated circuits of the printhead chips 57 and transfers received print data thereto in a form suitable to effect printing.

An example of a PEC integrated circuit which is suitable for driving the printhead chips is described in the Applicant's co-pending U.S. patent applications Ser. Nos. 09/575,108, 09/575,109, 09/575,110, 09/607,985, 09/607,990 and 09/606,999, which are incorporated herein by reference. However, a brief description of the circuit is provided as follows with reference to FIGS. 41 to 43.

The data flow and functions performed by the PEC integrated circuit 190 are described for a situation where the PEC integrated circuit is provided for driving a printhead 51 having a plurality of printhead modules 55; that is four modules as described above. As also described above, each printhead module 55 provides for six channels of fluid for printing, these being:

Cyan, Magenta and Yellow (CMY) for regular colour printing;

Black (K) for black text and other black or greyscale printing;

Infrared (IR) for tag-enabled applications; and

Fixative (F) to enable printing at high speed.

Figure 41:
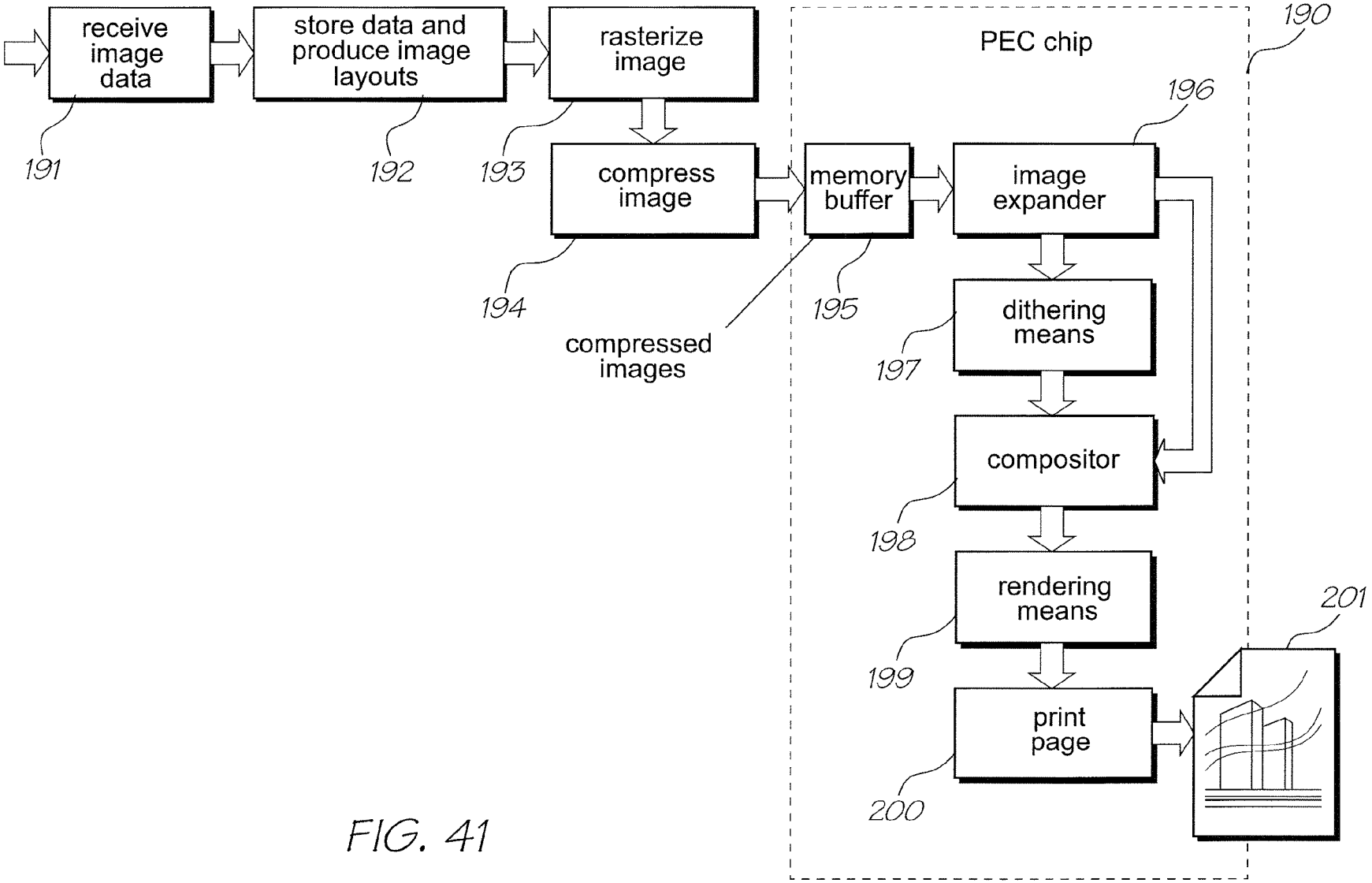
FIG. 41 illustrates data flow and functions performed by a print engine controller ("PEC") that forms one of the circuit components shown in FIG. 6.

As indicated in FIG. 41, images are supplied to the PEC integrated circuit 190 by a computer, which is programmed to perform the various processing steps 191 to 194 involved in printing an image prior to transmission to the PEC integrated circuit 190. These steps will typically involve receiving the image data (step 191) and storing this data in a memory buffer of the computer system (step 192) in which image layouts may be produced and any required objects may be added. Pages from the memory buffer are rasterized (step 193) and are then compressed (step 194) prior to transmission to the PEC integrated circuit 190. Upon receiving the image data, the PEC integrated circuit 190 processes the data so as to drive the integrated circuits of the printhead chips 57.

Due to the page-width form of the printhead assembly, each image should be printed at a constant speed to avoid creating visible artifacts. This means that the printing speed should be varied to match the input data rate. Document rasterization and document printing are therefore decoupled to ensure the printhead assembly has a constant supply of data. In this arrangement, an image is not printed until it is fully rasterized and, in order to achieve a high constant printing speed, a compressed version of each rasterized page image is stored in memory.

Because contone colour images are reproduced by stochastic dithering, but black text and line graphics are reproduced directly using dots, the compressed image format contains a separate foreground bi-level black layer and background contone colour layer. The black layer is composited over the contone layer after the contone layer is dithered. If required, a final layer of tags (in IR or black ink) is optionally added to the image for printout.

Dither matrix selection regions in the image description are rasterized to a contone-resolution bi-lev bitmap which is losslessly compressed to negligible size and which forms part of the compressed image. The IR layer of the printed page optionally contains encoded tags at a programmable density.

Each compressed image is transferred to the PEC integrated circuit 190 where it is then stored in a memory buffer 195. The compressed image is then retrieved and fed to an image expander 196 in which images are retrieved. If required, any dither may be applied to any contone layer by a dithering means 197 and any black bi-level layer may be composited over the contone layer by a compositor 198 together with any infrared tags which may be rendered by the rendering means 199. The PEC integrated circuit 190 then drives the integrated circuits of the printhead chips 57 to print the composite image data at step 200 to produce a printed image 201.

The process performed by the PEC integrated circuit 190 may be considered to consist of a number of distinct stages. The first stage has the ability to expand a JPEG-compressed contone CMYK layer. In parallel with this, bi-level IR tag data can be encoded from the compressed image. The second stage dithers the contone CMYK layer using a dither matrix selected by a dither matrix select map and, if required, composites a bi-level black layer over the resulting bi-level K layer and adds the IR layer to the image. A fixative layer is also generated at each dot position wherever there is a need in any of the C, M, Y, K, or IR channels. The last stage prints the bi-level CMYK+IR data through the printhead assembly 50.

Figure 42:
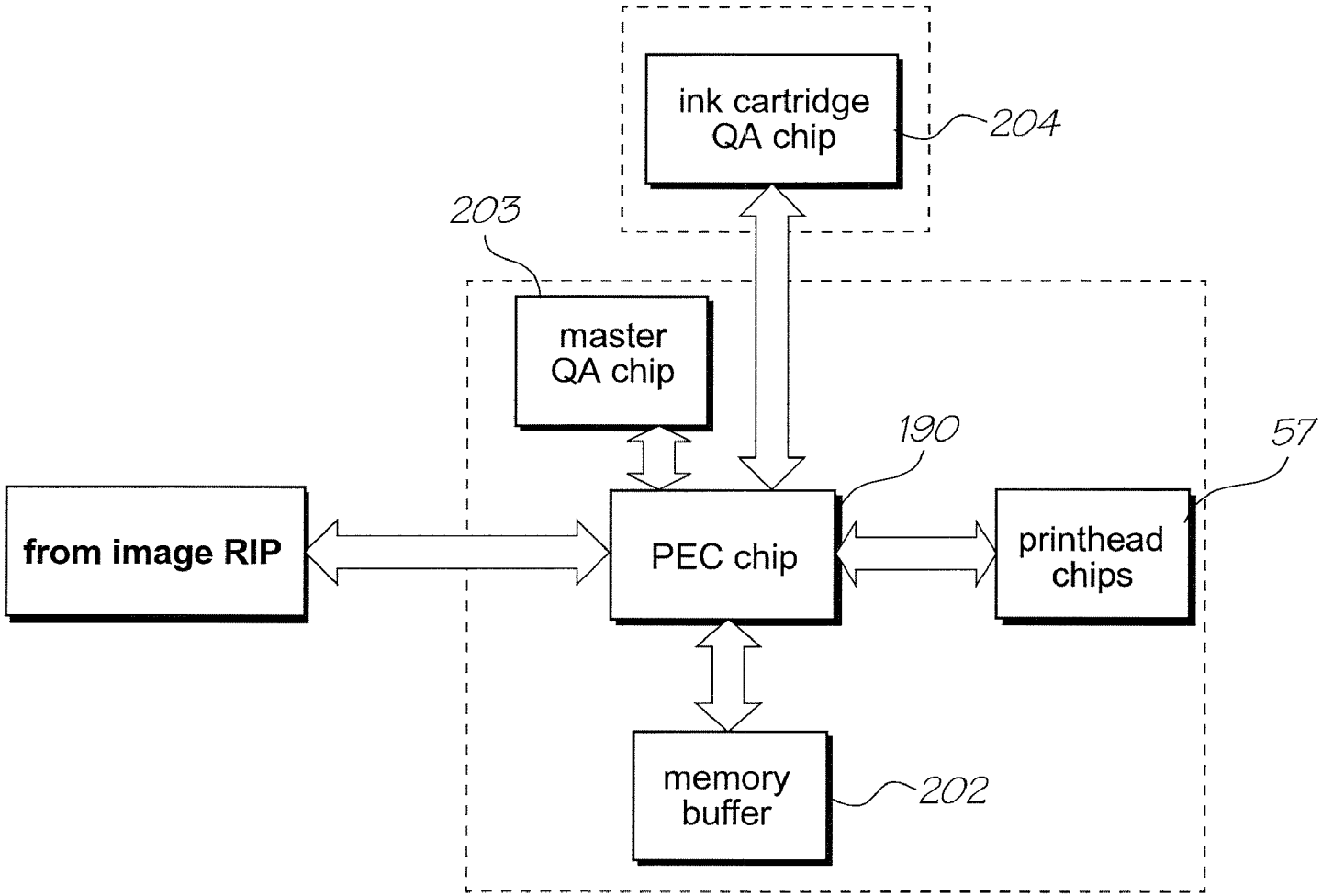
FIG. 42 illustrates the PEC of FIG. 41 in the context of an overall printing system architecture.
Figure 43:
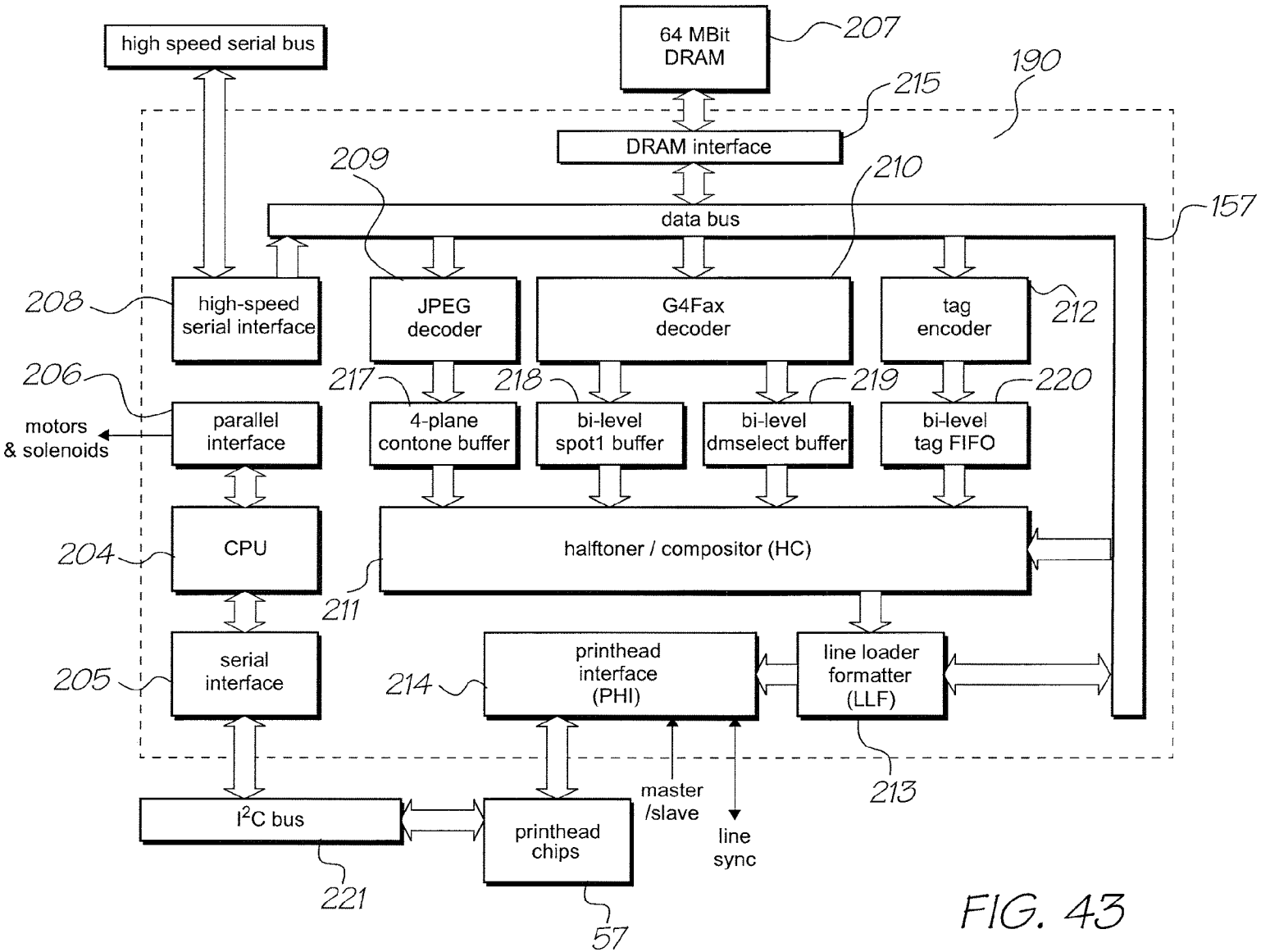
FIG. 43 illustrates the architecture of the PEC of FIG. 41.

FIG. 42 shows the PEC integrated circuit 190 in the context of the overall printing system architecture. The various components of the architecture include:

- The PEC integrated circuit 190 which is responsible for receiving the compressed page images for storage in a memory buffer 202, performing the page expansion, black layer compositing and sending the dot data to the printhead chips 57. The PEC integrated circuit 190 may also communicate with a master Quality Assurance (QA) integrated circuit 203 and with an ink cartridge Quality Assurance (QA) integrated circuit 204. The PEC integrated circuit 190 also provides a means of retrieving the printhead assembly characteristics to ensure optimum printing.
- The memory buffer 202 for storing the compressed image and for scratch use during the printing of a given page. The construction and working of memory buffers is known to those skilled in the art and a range of standard integrated circuits and techniques for their use might be utilized.
- The master integrated circuit 203 which is matched to the ink cartridge QA integrated circuit 204. The construction and working of QA integrated circuits is also known to those skilled in the art and a range of known QA processes might be utilized.

The PEC integrated circuit 190 effectively performs four basic levels of functionality:

- Receiving compressed pages via a serial interface such as an IEEE 1394.
- Acting as a print engine for producing an image from a compressed form. The print engine functionality includes expanding the image, dithering the contone layer, compositing the black layer over the contone layer, optionally adding infrared tags, and sending the resultant image to the integrated circuits of the printhead chips.
- Acting as a print controller for controlling the printhead chips 57 and the stepper motors 102, 108 and 111 of the printing system.
- Serving as two standard low-speed serial ports for communication with the two QA integrated circuits. In this regard, two ports are used, and not a single port, so as to ensure strong security during authentication procedures.

These functions are now described in more detail with reference to FIG. 21, which provides a more specific, exemplary illustration of the PEC integrated circuit architecture.

The PEC integrated circuit 190 incorporates a simple micro-controller CPU core 204 to perform the following functions:

- Perform QA integrated circuit authentication protocols via a serial interface 205 between print images.
- Run stepper motors of the printing system via a parallel interface 206 during printing to control delivery of the print media to the printer for printing.
- Synchronize the various components of the PEC integrated circuit 190 during printing.
- Provide a means of interfacing with external data requests (programming registers, etc).
- Provide a means of interfacing with the printhead assemblies' low-speed data requests (such as reading characterization vectors and writing pulse profiles).
- Provide a means of writing portrait and landscape tag structures to an external DRAM 207.

In order to perform the image expansion and printing process, the PEC integrated circuit 190 includes a high-speed serial interface 208 (such as a standard IEEE 1394 interface), a standard JPEG decoder 209, a standard Group 4 Fax decoder 210, a custom half-toner/compositor (HC) 211, a custom tag encoder 212, a line loader/formatter (LLF) 213, and a printhead interface 214 (PHI) which communicates with the printhead chips 57. The decoders 209 and 210 and the tag encoder 212 are buffered to the HC 211. The tag encoder 212 allocates infrared tags to images.

The print engine function works in a double-buffered manner. That is, one image is loaded into the external DRAM 207 via a DRAM interface 215 and a data bus 216 from the high-speed serial interface 208, while the previously loaded image is read from the DRAM 207 and passed through the print engine process. When the image has been printed, the image just loaded becomes the image being printed, and a new image is loaded via the high-speed serial interface 208.

At the aforementioned first stage, the process expands any JPEG-compressed contone (CMYK) layers, and expands any of two Group 4 Fax-compressed bi-level data streams. The two streams are the black layer and a matte for selecting between dither matrices for contone dithering. At the second stage, in parallel with the first, any tags are encoded for later rendering in either IR or black ink.

Finally, in the third stage the contone layer is dithered, and position tags and the bi-level spot layer are composited over the resulting bi-level dithered layer. The data stream is ideally adjusted to create smooth transitions across overlapping segments in the printhead assembly and ideally it is adjusted to compensate for dead nozzles in the printhead assemblies. Up to six channels of bi-level data are produced from this stage.

However, it will be understood that not all of the six channels need be activated. For example, the printhead modules 55 may provide for CMY only, with K pushed into the CMY channels and IR ignored. Alternatively, the position tags may be printed in K if IR ink is not employed. The resultant bi-level CMYK-IR dot-data is buffered and formatted for printing with the integrated circuits of the printhead chips 57 via a set of line buffers (not shown). The majority of these line buffers might be ideally stored on the external DRAM 207. In the final stage, the six channels of bi-level dot data are printed via the PHI 214.

The HC 211 combines the functions of half-toning the contone (typically CMYK) layer to a bi-level version of the same, and compositing the spot bi-level layer over the appropriate half-toned contone layer(s). If there is no K ink, the HC 211 functions to map K to CMY dots as appropriate. It also selects between two dither matrices on a pixel-by-pixel basis, based on the corresponding value in the dither matrix select map. The input to the HC 211 is an expanded contone layer (from the JPEG decoder 205) through a buffer 217, an expanded bi-level spot1 layer through a buffer 218, an expanded dither-matrix-select bitmap at typically the same resolution as the contone layer through a buffer 219, and tag data at full dot resolution through a buffer (FIFO) 220.

The HC 211 uses up to two dither matrices, read from the external DRAM 207. The output from the HC 211 to the LLF 213 is a set of printer resolution bi-level image lines in up to six colour planes. Typically, the contone layer is CMYK or CMY, and the bi-level spot1 layer is K. Once started, the HC 211 proceeds until it detects an "end-of-image" condition, or until it is explicitly stopped via a control register (not shown).

The LLF 213 receives dot information from the HC 211, loads the dots for a given print line into appropriate buffer storage (some on integrated circuit (not shown) and some in the external DRAM 207) and formats them into the order required for the integrated circuits of the printhead chips 57. More specifically, the input to the LLF 213 is a set of six 32-bit words and a Data Valid bit, all generated by the HC 211.

As previously described, the physical location of the nozzles 150 on the printhead chips is in two offset rows 151, which means that odd and even dots of the same colour are for two different lines. In addition, there is a number of lines between the dots of one colour and the dots of another. Since the six colour planes for the same dot position are calculated at one time by the HC 211, there is a need to delay the dot data for each of the colour planes until the same dot is positioned under the appropriate colour nozzle. The size of each buffer line depends on the width of the printhead assembly. A single PEC integrated circuit 190 may be employed to generate dots for up to 16 printhead chips 57 and, in such case, a single odd or even buffer line is therefore 16 sets of 640 dots, for a total of 10,240 bits (1280 bytes).

The PHI 214 is the means by which the PEC integrated circuit 190 loads the printhead chips 57 with the dots to be printed, and controls the actual dot printing process. It takes input from the LLF 213 and outputs data to the printhead chips 57. The PHI 214 is capable of dealing with a variety of printhead assembly lengths and formats.

A combined characterization vector of each printhead assembly 50 and 51 can be read back via the serial interface 205. The characterization vector may include dead nozzle information as well as relative printhead module alignment data. Each printhead module can be queried via a low-speed serial bus 221 to return a characterization vector of the printhead module.

The characterization vectors from multiple printhead modules can be combined to construct a nozzle defect list for the entire printhead assembly and allows the PEC integrated circuit 190 to compensate for defective nozzles during printing. As long as the number of defective nozzles is low, the compensation can produce results indistinguishable from those of a printhead assembly with no defective nozzles.

Some of the features of a pagewidth printhead that incorporates the chip and the print engine controller which have been described above are summarised as follows:

1. The printhead will normally have at least four color channels.
2. The printhead will normally incorporate at least 1400 ink delivery nozzles per inch of print width for each color.
3. The printhead may incorporate a total of at least 50,000 nozzles.
4. The dot printing processing rate and the drop deposition rate of the printhead may be of the order of $10^9$ $sec^{-1}$ or greater.
5. The volume deposited per drop may be of the order of $2\times1^{-12}$ l or less.
6. The energy level expenditure per drop ejection may be of the order of $200\times10^{-9}$ J. or less.

It will be understood that the constructional and operating principles of the printer of the present invention may be realised with various embodiments. Thus, variations and modifications may be made in respect of the embodiments as specifically described above by way of example.

The invention claimed is:

1. An inkjet printer comprising:

at least one pagewidth printhead having a plurality of ink ejection nozzles;

a capping/purging member having a length corresponding substantially to that of the printhead;

a first actuating mechanism arranged to move the printhead in an arcuate first direction between first, second and third positions; and a second actuating mechanism arranged to move the capping/purging member in an arcuate second direction opposite to the first direction to cap the nozzles of the printhead when the printhead is in the second position and to permit purging of ink from the nozzles when the printhead is in the third position.

2. A printer as claimed in claim 1 wherein the capping/purging member is formed effectively as a one-piece member.

3. A printer as claimed in claim 1 wherein the capping/purging member comprises conjoined member portions having an aggregate length corresponding substantially to that of the printhead.

4. A printer as claimed in claim 1 wherein the capping/purging member comprises a body portion, a lip portion formed from an elastomeric material, a capping cavity surrounded by the lip portion, and a purging chamber surrounded by the lip portion.

5. A printer as claimed in claim 1 wherein the purging chamber is connected to a suction device.

6. A printer according to claim 1, comprising two opposed pagewidth printheads, wherein the first actuating mechanism is arranged to effect relative movement of the printheads between the first and second positions and the second actuating mechanism is arranged to interpose the capping/purging member between the printheads when the printheads are in the second position.

7. A printer according to claim 6, wherein the printheads are offset.

8. A printer according to claim 1, comprising a carrier positioned adjacent the printhead which carries the capping/purging member, wherein the second actuating mechanism is arranged to pivot the carrier to move the capping/purging member.

9. A printer according to claim 1, wherein the capping/purging member comprises:

a lip portion that is formed integrally with a body portion; and a cavity surrounded by the lip portion, the lip portion being peripherally configured to surround the nozzles on the printhead and the body portion having a length corresponding substantially to that of the printhead.

* * * * *